US010796589B2

(12) United States Patent
PR et al.

(10) Patent No.: US 10,796,589 B2
(45) Date of Patent: Oct. 6, 2020

(54) SYSTEMS AND METHODS FOR PROVIDING CIRCLING APPROACH DATA ONBOARD AN AIRCRAFT

(71) Applicant: HONEYWELL INTERNATIONAL INC., Morris Plains, NJ (US)

(72) Inventors: Sriram PR, Tamilnadu (IN); Steve Cirino, Akron, OH (US); Nathan Shaughn Turner, Phoenix, AZ (US); Jayasenthilnathan B, Karnataka (IN); Satish Narayan Hedge, Karnataka (IN); Sanju Kuriakose, Karnataka (IN); Sreenath Sukumar, Kerala (IN)

(73) Assignee: Honeywell International Inc., Morris Plains, NJ (US)

( * ) Notice: Subject to any disclaimer, the term of this patent is extended or adjusted under 35 U.S.C. 154(b) by 255 days.

(21) Appl. No.: 15/918,076

(22) Filed: Mar. 12, 2018

(65) Prior Publication Data

US 2019/0279516 A1 Sep. 12, 2019

(51) Int. Cl.
*G08G 5/02* (2006.01)
*G08G 5/00* (2006.01)

(52) U.S. Cl.
CPC ..... *G08G 5/025* (2013.01); *G08G 5/006* (2013.01); *G08G 5/0013* (2013.01); *G08G 5/0021* (2013.01); *G08G 5/0034* (2013.01)

(58) Field of Classification Search
CPC combination set(s) only.
See application file for complete search history.

(56) References Cited

U.S. PATENT DOCUMENTS 6,127,944 A 10/2000 Daly et al.
6,438,469 B1 * 8/2002 Dwyer ..... G08G 5/025 340/945

(Continued)

FOREIGN PATENT DOCUMENTS

CN 103699132 A 4/2014
EP 1254445 A1 11/2002

OTHER PUBLICATIONS

"A Flight Simulation Study of the Simultaneous Non-Interfering Aircraft Approach", Brian Reel, California Polytechnic State University, San Luis Obispo, May 2009 (Year: 2009).*

*Primary Examiner* — Christian Chace
*Assistant Examiner* — Amelia J. I. Vorce
(74) *Attorney, Agent, or Firm* — Bookoff McAndrews, PLLC

(57) ABSTRACT

A method for providing circling approach data onboard an aircraft is disclosed. For a current, circling approach of the aircraft to a destination airport, the method identifies a circling approach procedure applicable to an optimal runway, by a processor communicatively coupled to a system memory element configured to store a database of circling approach procedures and a source for temporary restrictions; determines a circling boundary to the optimal runway, based on the circling approach procedure; determines temporary circling restrictions for the aircraft, based on conflicting traffic from at least a second airport; constructs a lateral path and a vertical path to guide the aircraft to the optimal runway of the destination airport, based on the circling approach procedure, the circling boundary, and the temporary circling restrictions; and presents graphical elements and text associated with the circling approach procedure, the circling boundary, and the temporary restrictions, by a display device.

18 Claims, 16 Drawing Sheets

(56) References Cited

U.S. PATENT DOCUMENTS

| | | | | |
|---|---|---|---|---|
| 6,871,124 | B1 | 3/2005 | McElreath | |
| 8,078,344 | B2 | 12/2011 | Dwyer et al. | |
| 8,332,083 | B1 * | 12/2012 | McCusker | G05D 1/0676 340/945 |
| 8,615,337 | B1 * | 12/2013 | McCusker | G01C 21/20 701/1 |
| 9,257,048 | B1 * | 2/2016 | Offer | G08G 5/0021 |
| 2006/0241820 | A1 | 10/2006 | Dwyer et al. | |
| 2011/0202206 | A1 | 8/2011 | Karthikeyan et al. | |
| 2017/0018196 | A1 * | 1/2017 | Shay | G08G 5/045 |
| 2017/0084182 | A1 * | 3/2017 | Conway | G08G 5/02 |
| 2017/0270808 | A1 | 9/2017 | Onomura et al. | |
| 2017/0358218 | A1 * | 12/2017 | Einset | G06N 20/00 |
| 2018/0061246 | A1 * | 3/2018 | Adler | G08G 5/0039 |
| 2018/0218615 | A1 * | 8/2018 | Myr | G08G 5/0043 |
| 2018/0281948 | A1 * | 10/2018 | Tao | G05B 19/048 |
| 2019/0011935 | A1 * | 1/2019 | Ham | G01S 17/023 |
| 2019/0122569 | A1 * | 4/2019 | Villele | G08G 5/02 |

* cited by examiner

SYSTEMS AND METHODS FOR PROVIDING CIRCLING APPROACH DATA ONBOARD AN AIRCRAFT

TECHNICAL FIELD

Embodiments of the subject matter described herein relate generally to computing and presenting circling approach data onboard an aircraft. More particularly, embodiments of the subject matter relate to guiding an aircraft to an optimal runway based on aircraft parameters, conflicting traffic, and an appropriate circling approach.

BACKGROUND

A circling approach may be used by flight crews to land at a particular airport. Circling approaches are one of the more difficult aircraft maneuvers to perform, particularly during low visibility conditions (e.g., snow, rain). Spatial problems during circling maneuvers are a concern for aviation administrative, oversight, and regulatory agencies. Currently, circling to land operation is performed by the pilot based on information available in applicable aviation charts (e.g., a Minimum Descent Altitude (MDA), speed constraints, space constraints) and applicable traffic information. During a circling approach, a pilot maintains visual contact with an intended runway and flies no lower than the circling minimums until positioned to make a final descent for a landing. During heavy workload times (e.g., approach), it becomes difficult for the pilot to visualize the spacing restrictions, altitude restrictions, speed restrictions, and traffic restrictions required for landing.

Accordingly, it is desirable to provide additional circling approach data onboard the aircraft. Furthermore, other desirable features and characteristics will become apparent from the subsequent detailed description and the appended claims, taken in conjunction with the accompanying drawings and the foregoing technical field and background.

BRIEF SUMMARY

Some embodiments of the present disclosure provide a method for providing circling approach data onboard an aircraft. For a current approach of the aircraft to a destination airport, the current approach comprising a circling approach, the method identifies a circling approach procedure applicable to an optimal runway of the destination airport, by a processor communicatively coupled to a system memory element configured to store a database of circling approach procedures and a source for temporary restrictions, wherein the database of circling approach procedures comprises at least the circling approach procedure; determines a circling boundary to the optimal runway, by the processor, based on the circling approach procedure; determines temporary circling restrictions for the aircraft, by the processor, based on conflicting traffic from at least a second airport; constructs a lateral path and a vertical path to guide the aircraft to the optimal runway of the destination airport, by the processor, based on the circling approach procedure, the circling boundary, and the temporary circling restrictions; and presents graphical elements and text associated with the circling approach procedure, the circling boundary, and the temporary restrictions, by a display device communicatively coupled to the processor.

Some embodiments of the present disclosure provide a system for providing circling approach data onboard an aircraft. The system includes: a system memory element configured to store a database of circling approach procedures and a source for temporary restrictions; a display device, configured to present a visual representation of the circling approach data; and at least one processor communicatively coupled to the system memory element and the display device. For a current approach of the aircraft to a destination airport, the current approach comprising a circling approach, the at least one processor is configured to: identify a circling approach procedure applicable to an optimal runway of the destination airport, wherein the database of circling approach procedures comprises at least the circling approach procedure; determine a circling boundary to the optimal runway, based on the circling approach procedure; determine temporary circling restrictions for the aircraft, based on conflicting traffic from at least a second airport; construct a lateral path and a vertical path to guide the aircraft to the optimal runway of the destination airport, based on the circling approach procedure, the circling boundary, and the temporary circling restrictions; and present graphical elements and text associated with the circling approach procedure, the circling boundary, and the temporary circling restrictions, via the display device.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

The subject matter presented herein relates to systems and methods for guiding an aircraft to land at a particular airport using a circling boundary. More specifically, the subject matter relates to identifying the most optimal runway for the aircraft to land at the particular airport, and providing a circling boundary data and guidance to land the aircraft at the most optimal runway at a particular airport, based on current conditions including aircraft parameters, current conditions, and airport requirements. Also contemplated herein is identifying airport restrictions based on traffic information, and modifying the circling boundary data and landing guidance data based on the airport restrictions.

Certain terminologies are used with regard to the various embodiments of the present disclosure. The destination airport is a predetermined airport toward which the aircraft is traveling, as part of a preconfigured flight plan. The optimal runway is the most favorable runway (of all of the available runways at the destination airport) for the aircraft to land, based on current conditions of the aircraft and the airport. A circling approach is a maneuver initiated by flight crew of the aircraft to align the aircraft with a runway for landing when a straight-in landing from an instrument approach is not possible or desirable. A circling approach procedure applicable to the optimal runway includes the appropriate aircraft maneuvers such that the aircraft may perform a circle-to-land operation to land on the optimal runway. The circling boundary is a boundary of protected airspace for a circling approach, which is usually defined by arcs drawn from the threshold of each runway at an airport. Temporary circling restrictions prevent the aircraft from entering airspace which may be entered and/or occupied by secondary aircraft traffic, thereby preventing collision of the aircraft with such secondary aircraft. Circling boundaries for airports in close proximity to each other may overlap. In other words, a first airport includes a first circling boundary, a second airport includes a second circling boundary, and the first circling boundary and the second circling boundary each include one shared and overlapping region of airspace.

Figure 1:
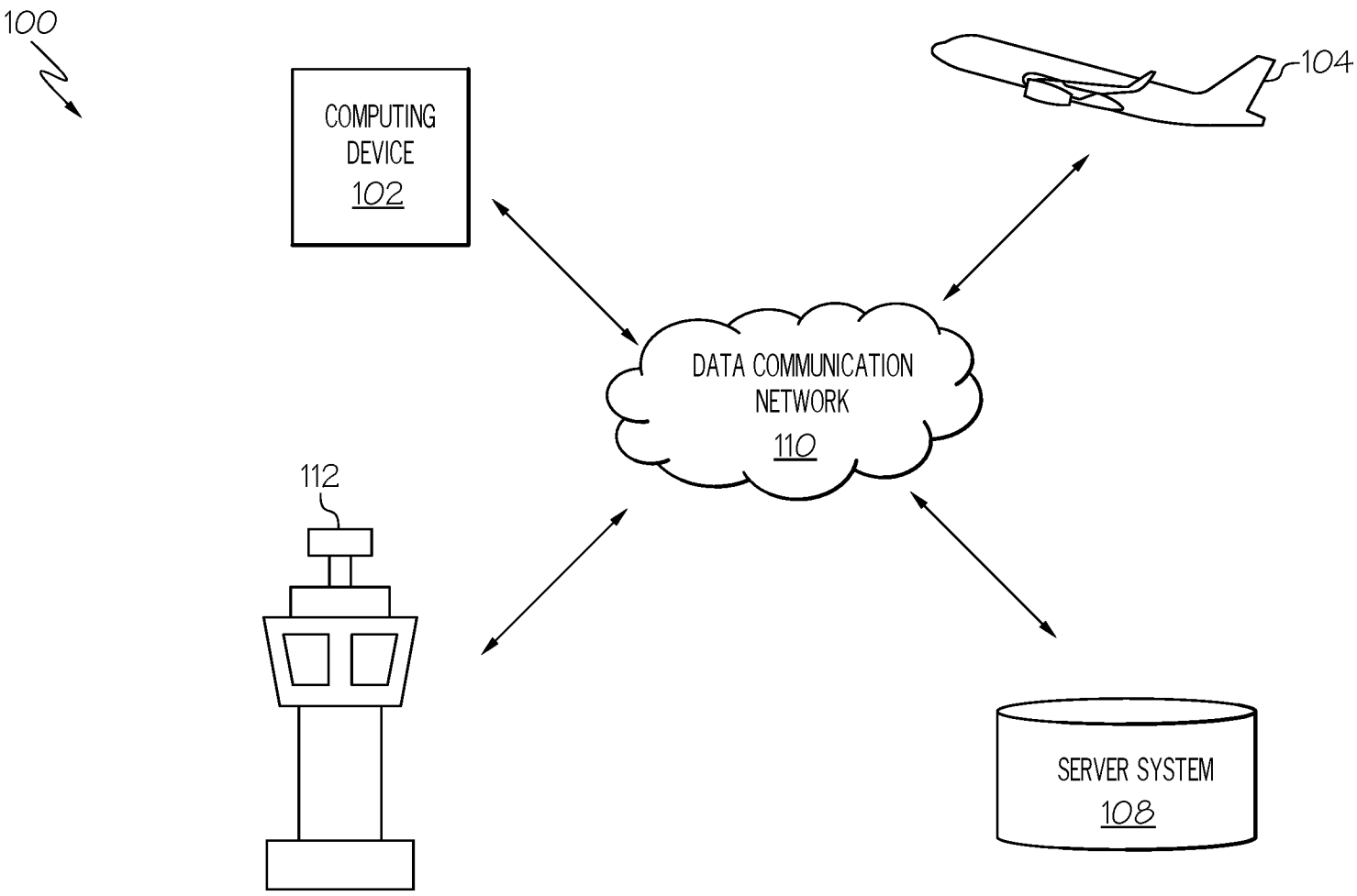
FIG. 1 is a diagram of a circling approach system, in accordance with the disclosed embodiments.

Turning now to the figures, FIG. 1 is a diagram of a circling approach system 100, in accordance with the disclosed embodiments. The circling approach system 100 operates to compute and present circling approach data for an aircraft 104 traveling to a destination airport. The circling approach system 100 may include, without limitation, a computing device 102 that communicates with (i) one or more sensors and avionics systems onboard the aircraft 104, (ii) at least one server system 108, and (iii) an Air Traffic Control (ATC) or ground control center 112, via a data communication network 110. In practice, certain embodiments of the circling approach system 100 may include additional or alternative elements and components, as desired for the particular application.

The computing device 102 may be implemented by any computing device that includes at least one processor, some form of memory hardware, a user interface, and communication hardware. For example, the computing device 102 may be implemented using a personal computing device, such as a tablet computer, a laptop computer, a personal digital assistant (PDA), a smartphone, or the like. In this scenario, the computing device 102 is capable of storing, maintaining, and executing an Electronic Flight Bag (EFB) application configured to compute and present circling approach data for a destination airport. In other embodiments, the computing device 102 may be implemented using a computer system onboard the aircraft 104, which is configured to compute and present circling approach data for a destination airport.

The aircraft 104 may be any aviation vehicle for which circling approach data is relevant and applicable during approach and landing at a particular destination airport. The aircraft 104 may be implemented as an airplane, helicopter, spacecraft, hovercraft, or the like.

The server system 108 may include any number of application servers, and each server may be implemented using any suitable computer. In some embodiments, the server system 108 includes one or more dedicated computers. In some embodiments, the server system 108 includes one or more computers carrying out other functionality in addition to server operations. The server system 108 is generally configured to store and provide access to one or more aviation databases, which may include but are not limited to: navigation databases, obstacle databases, Notices to Airmen (NOTAMs), or the like. The server system 108 may store and provide any type of data used to calculate circling approach data. Such data may include, without limitation: runway data, aircraft types and/or aircraft categories, wind data, Minimum Descent Altitudes (MDAs), published approach chart data, circling radii guidelines, and other data compatible with the computing device 102.

The computing device 102 is usually located onboard the aircraft 104, and the computing device 102 communicates with the one or more avionics systems and sensors onboard the aircraft 104 via wired and/or wireless communication connection. The computing device 102 and the server system 108 are generally disparately located, and the computing device 102 communicates with the server system 108 via the data communication network 110 and/or via communication mechanisms onboard the aircraft 104.

The data communication network 110 may be any digital or other communications network capable of transmitting messages or data between devices, systems, or components. In certain embodiments, the data communication network 110 includes a packet switched network that facilitates packet-based data communication, addressing, and data routing. The packet switched network could be, for example, a wide area network, the Internet, or the like. In various embodiments, the data communication network 110 includes any number of public or private data connections, links or network connections supporting any number of communications protocols. The data communication network 110 may include the Internet, for example, or any other network based upon TCP/IP or other conventional protocols. In various embodiments, the data communication network 110 could also incorporate a wireless and/or wired telephone network, such as a cellular communications network for communicating with mobile phones, personal digital assistants, and/or the like. The data communication network 110 may also incorporate any sort of wireless or wired local and/or personal area networks, such as one or more IEEE 802.3, IEEE 802.16, and/or IEEE 802.11 networks, and/or networks that implement a short range (e.g., Bluetooth) protocol. For the sake of brevity, conventional techniques related to data transmission, signaling, network control, and other functional aspects of the systems (and the individual operating components of the systems) may not be described in detail herein.

During typical operation, the computing device 102 obtains relevant data associated with a destination airport, and identifies an optimal runway for landing the aircraft 104 at the destination airport using a circling approach. The computing device 102 also identifies a circling approach procedure, including lateral and vertical flight guidance, a circling boundary, and temporary circling restrictions for performing a circle-to-land procedure at the optimal runway of the destination airport. The computing device 102 then presents a graphical display of the lateral and vertical flight guidance, the circling boundary, and the temporary circling restrictions for viewing by a user onboard the aircraft 104 during flight.

Figure 2:
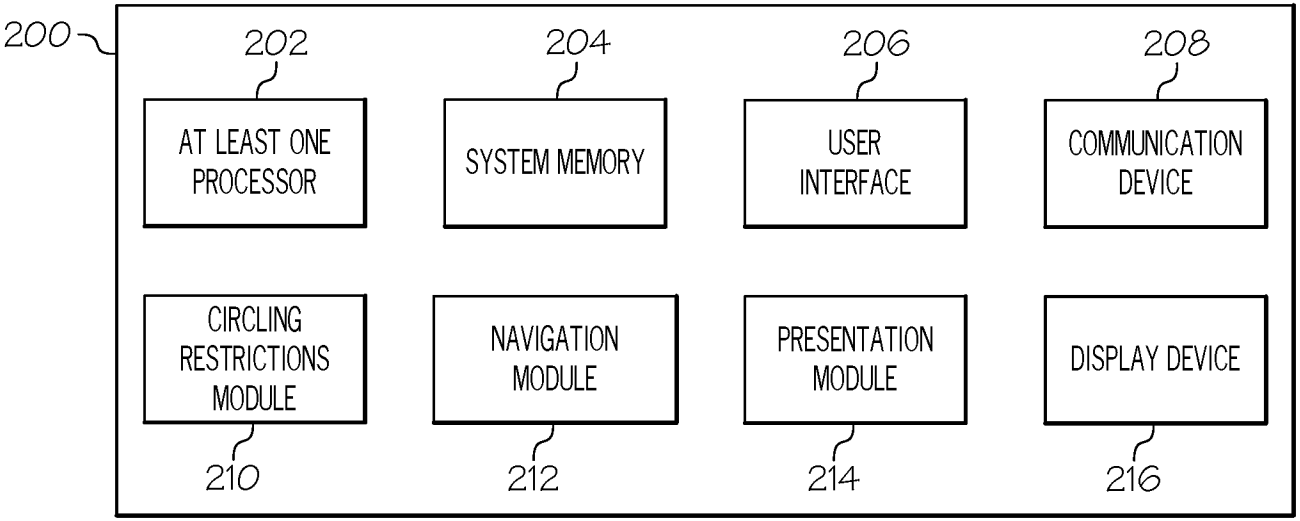
FIG. 2 is a functional block diagram of a computing device, in accordance with the disclosed embodiments.

FIG. 2 is a functional block diagram of a computing device 200, in accordance with the disclosed embodiments. It should be noted that the computing device 200 can be implemented with the computing device 102 depicted in FIG. 1. In this regard, the computing device 200 shows certain elements and components of the computing device 200 in more detail. The computing device 200 generally includes, without limitation: at least one processor 202; system memory 204; a user interface 206; a communication device 208; a circling restrictions module 210; a navigation module 212; a presentation module 214; and a display device 216. These elements and features of the computing device 200 may be operatively associated with one another, coupled to one another, or otherwise configured to cooperate with one another as needed to support the desired functionality—in particular, dynamically computing and presenting circling approach data onboard an aircraft during approach and landing phases of flight, as described herein. For ease of illustration and clarity, the various physical, electrical, and logical couplings and interconnections for these elements and features are not depicted in FIG. 2. Moreover, it should be appreciated that embodiments of the computing device 200 will include other elements, modules, and features that cooperate to support the desired functionality. For simplicity, FIG. 2 only depicts certain elements that relate to the circling approach data identification and presentation techniques described in more detail below.

The at least one processor 202 may be implemented or performed with one or more general purpose processors, a content addressable memory, a digital signal processor, an application specific integrated circuit, a field programmable gate array, any suitable programmable logic device, discrete gate or transistor logic, discrete hardware components, or any combination designed to perform the functions described here. In particular, the at least one processor 202 may be realized as one or more microprocessors, controllers, microcontrollers, or state machines. Moreover, the at least one processor 202 may be implemented as a combination of computing devices, e.g., a combination of digital signal processors and microprocessors, a plurality of microprocessors, one or more microprocessors in conjunction with a digital signal processor core, or any other such configuration.

The at least one processor 202 is communicatively coupled to the system memory 204. The system memory 204 is configured to store any obtained or generated data and/or graphical elements associated with circling approach data, flight guidance, and temporary flight restriction data. The system memory 204 may be realized using any number of devices, components, or modules, as appropriate to the embodiment. Moreover, the computing device 200 could include system memory 204 integrated therein and/or a system memory 204 operatively coupled thereto, as appropriate to the particular embodiment. In practice, the system memory 204 could be realized as RAM memory, flash memory, EPROM memory, EEPROM memory, registers, a hard disk, a removable disk, or any other form of storage medium known in the art. In certain embodiments, the system memory 204 includes a hard disk, which may also be used to support functions of the computing device 200. The system memory 204 can be coupled to the at least one processor 202 such that the at least one processor 202 can read information from, and write information to, the system memory 204. In the alternative, the system memory 204 may be integral to the at least one processor 202. As an example, the at least one processor 202 and the system memory 204 may reside in a suitably designed application-specific integrated circuit (ASIC).

The user interface 206 may include or cooperate with various features to allow a user to interact with the computing device 200. Accordingly, the user interface 206 may include various human-to-machine interfaces, e.g., a keypad, keys, a keyboard, buttons, switches, knobs, a touchpad, a joystick, a pointing device, a virtual writing tablet, a touch screen, a microphone, or any device, component, or function that enables the user to select options, input information, or otherwise control the operation of the computing device 200. For example, the user interface 206 could be manipulated by an operator to make selections associated with a destination airport, an optimal runway, lateral and/or vertical flight guidance, and/or circling approach data, as described herein.

In certain embodiments, the user interface 206 may include or cooperate with various features to allow a user to interact with the computing device 200 via graphical elements rendered on a display element (e.g., the display device 216). Accordingly, the user interface 206 may initiate the creation, maintenance, and presentation of a graphical user interface (GUI). In certain embodiments, the display device 216 implements touch-sensitive technology for purposes of interacting with the GUI. Thus, a user can manipulate the GUI by moving a cursor symbol rendered on the display device 216, or by physically interacting with the display device 216 itself for recognition and interpretation, via the user interface 206.

The communication device 208 is suitably configured to communicate data (i) between the computing device 200 and one or more remote servers, (ii) between the computing device 200 and one or more sensors and avionics systems onboard an aircraft, and (iii) between the computing device 200 and one or more ground control or Air Traffic Control (ATC) centers. The communication device 208 may transmit and receive communications over a wireless local area network (WLAN), the Internet, a satellite uplink/downlink, a cellular network, a broadband network, a wide area network, or the like. As described in more detail below, data received by the communication device 208 may include, without limitation: flight plan data, runway analysis data, published approach chart data, circling radii guidelines, Minimum Descent Altitudes (MDAs), aircraft types and/or aircraft categories, estimated times of arrival and departure provided by ATC or ground control centers, and other data compatible with the computing device 200. Data provided by the communication device 208 may include, without limitation, requests for aircraft onboard sensor data, requests for aircraft onboard avionics data, requests for aviation data stored by a remote server, requests for departure and arrival times for secondary aircraft, and the like.

A circling restrictions module 210 is suitably configured to identify circling restrictions for a first aircraft landing at a first airport, based on conflicting air traffic within a circling boundary for a second airport. The circling restrictions module 210 identifies overlapping airspace between two circling boundaries associated with two airports in close proximity to each other. The circling restrictions module 210 also obtains estimated time of arrival data and estimated departure time data for one or more secondary aircraft arriving or departing a second airport. Generally, the estimated arrival and departure times are obtained from a ground control center or an Air Traffic Control (ATC) center via the communication device 208. Circling restrictions include times when the aircraft cannot use the first circling boundary associated with the first airport due to the simultaneous use of the second circling boundary (associated with the second airport) by a second aircraft. In this way, the circling restrictions module 210 obtains and determines appropriate circling restrictions (i.e., times when the aircraft cannot land at the first airport due to potential collisions) for landing the aircraft at the first airport.

The navigation module 212 is configured to determine appropriate flight guidance, including circling approach data, for the aircraft to fly to the optimal runway and perform a circle-to-land procedure. In this way, the navigation module 212 determines lateral flight guidance and vertical flight guidance to the optimal runway, a circling approach procedure to the optimal runway, and a circling boundary for use performing the circle-to-land procedure at the optimal runway.

The presentation module 214 is configured to present (via the display device 216) graphical elements and text associated with the flight guidance and circling approach data onboard the aircraft. The graphical elements and text associated with the circling approach generally include, without limitation, representations of the destination airport, the optimal runway, the lateral path, the vertical path, and the circling boundary associated with the optimal runway. In some embodiments, the graphical elements and text associated with the circling approach further represent a missed approach point, a non-flyable region of the circling boundary, and a minimum decision altitude. In some embodiments, the graphical elements and text include a visual representation of a current trend of the aircraft in the circling boundary. In some embodiments, the graphical elements and text include a visual representation of a distance from a current location of the aircraft to the optimal runway. In some embodiments, the graphical elements and text include multimodal alerts associated with a potential violation of protected airspace covered by the circling boundary.

In practice, the circling restrictions module 210, the navigation module 212, and the presentation module 214 may be implemented with (or cooperate with) the at least one processor 202 to perform at least some of the functions and operations described in more detail herein. In this regard, the circling restrictions module 210, the navigation module 212, and the presentation module 214 may be realized as suitably written processing logic, application program code, or the like.

The display device 216 is configured to display various icons, text, and/or graphical elements associated with flight guidance, destination airport data, optimal runway data, circling approach data, or the like. In an exemplary embodiment, the display device 216 is communicatively coupled to the user interface 206 and the at least one processor 202. The at least one processor 202, the user interface 206, and the display device 216 are cooperatively configured to display, render, or otherwise convey one or more graphical representations or images associated with flight guidance, circling approach data, and temporary circling restrictions on the display device 216, as described in greater detail below. In an exemplary embodiment, the display device 216 is realized as an electronic display configured to graphically display flight guidance, circling approach data, and temporary circling restriction data, as described herein. In some embodiments, the computing device 200 is an integrated computer system onboard an aircraft, and the display device 216 is located within a cockpit of the aircraft, and is thus implemented as an aircraft display. In other embodiments, the display device 216 is implemented as a display screen of a standalone, personal computing device (e.g., laptop computer, tablet computer). It will be appreciated that although the display device 216 may be implemented using a single display, certain embodiments may use additional displays (i.e., a plurality of displays) to accomplish the functionality of the display device 216 described herein.

FIGS. 3-7 illustrate embodiments of graphical elements and text associated with lateral and vertical flight guidance to an optimal runway at a destination airport, and circling approach data to guide the aircraft during performance of a circle-to-land procedure at the optimal runway, as described below with regard to FIG. 15, reference 1510. Such graphical elements and text may be presented by an integrated display onboard the aircraft and/or via a display of a computing device communicatively coupled to avionics systems onboard the aircraft.

Figure 3:
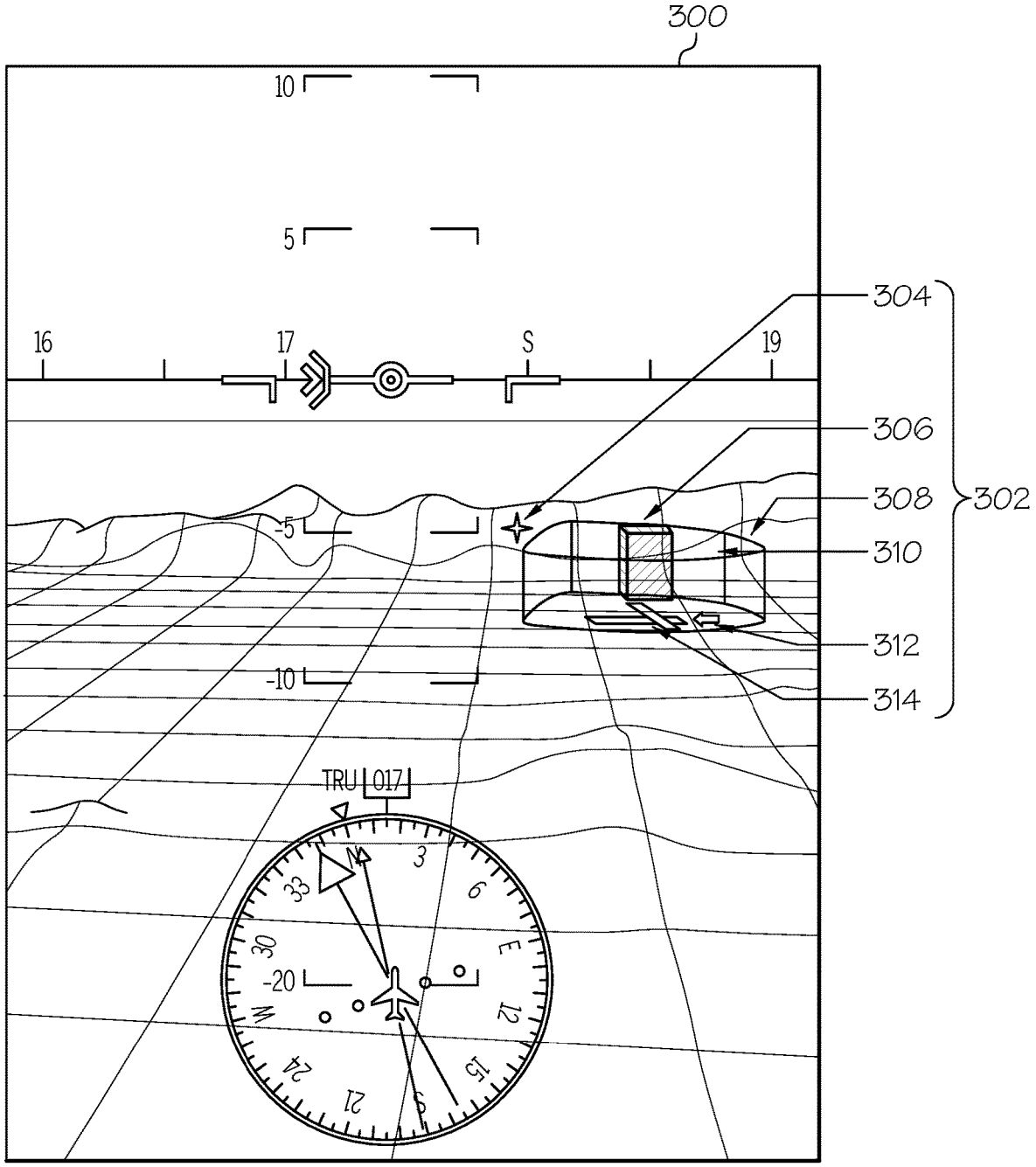
FIG. 3 is an active circling approach display during approach, in accordance with the disclosed embodiments.

FIG. 3 is an active circling approach display 300 presented during approach, in accordance with the disclosed embodiments. As shown, the circling approach display 300 presents graphical elements and text associated with circling approach data 302 applicable to a particular runway (e.g., a predetermined "optimal" runway at a destination airport). The circling approach data includes, without limitation: a missed approach point 304, a non-flyable region of the circling boundary 306, a Minimum Descent Altitude (MDA) 308, a circling boundary 310, an optimal runway 312 based on wind calculations, and a destination airport 314. The missed approach point 304 is the point prescribed in each instrument approach at which a missed approach procedure shall be executed if the required visual reference does not exist. The non-flyable region of the circling boundary 306 is an airspace region restricted from flight by the aircraft, during performance of a circle-to-land procedure performed by the aircraft. The MDA 308 is a specified altitude in a circling approach, below which descent must not be made without the required visual reference. The circling boundary 310 is a boundary of protected airspace for a circling approach, which is usually defined by arcs drawn from the threshold of each runway at an airport. The optimal runway 312 is the most favorable runway (of all of the available runways at the destination airport) for the aircraft to land, based on current conditions of the aircraft and the airport.

The circling approach display 300 displays the circling boundary 310 and the MDA 308 for a particular aircraft category as read from the chart for that particular approach. To increase situational awareness onboard the aircraft, the circling boundary 310, the circling restrictions, the operational restrictions, and the MDA 308 is displayed using synthetic vision onboard the aircraft, as a horizontal plane defined at the circling minima altitude. While flying the circling approach, the system monitors and presents the vertical trend via the display system. Aircraft descent below the MDA 308. The minimum altitude data may be depicted on the Vertical Situation Display (VSD) and other aircraft avionics displays.

Figure 4:
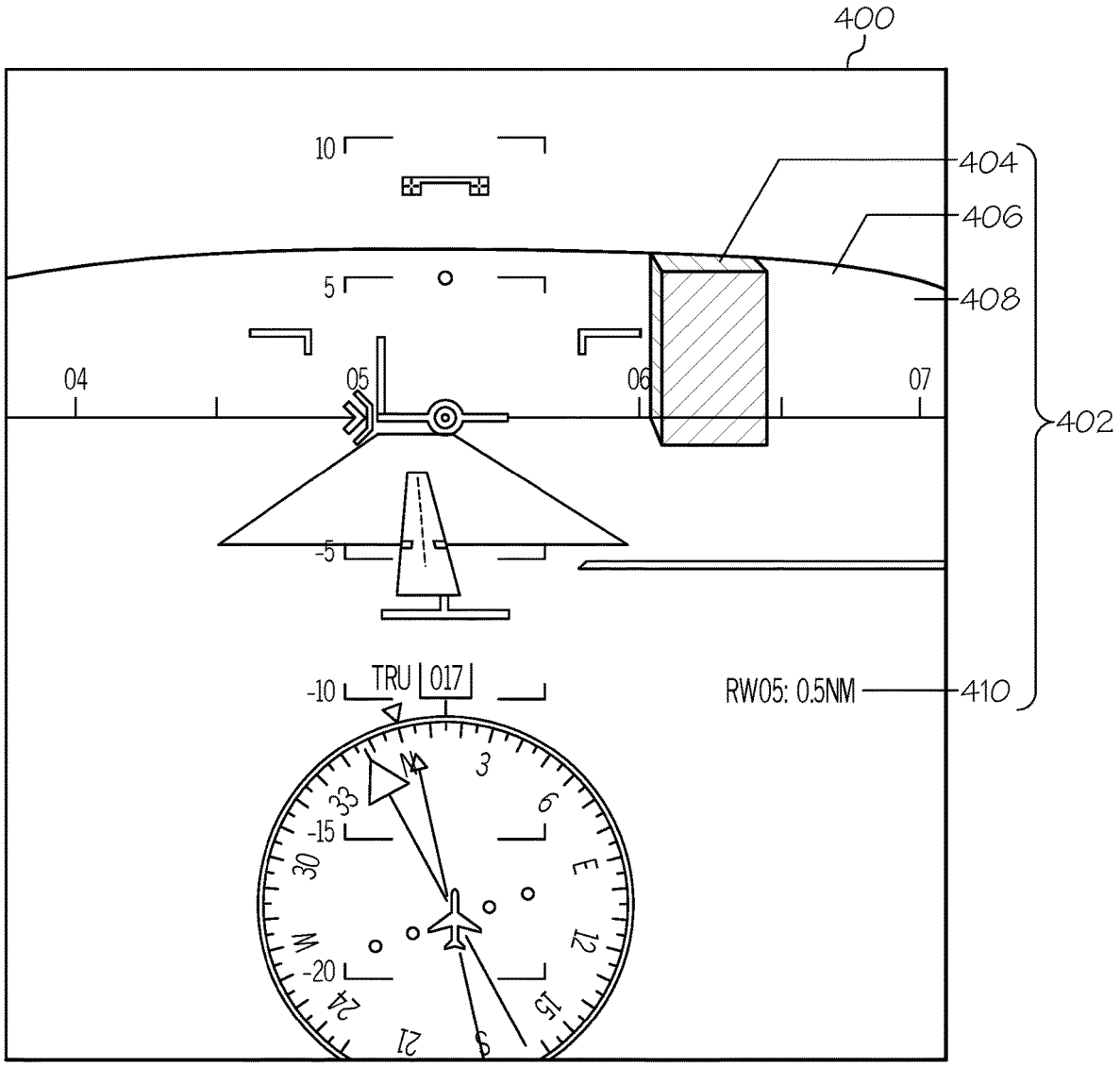
FIG. 4 is an active circling approach display within the circling boundary, in accordance with the disclosed embodiments.

FIG. 4 is an active circling approach display 400 within the circling boundary, in accordance with the disclosed embodiments. Here, the circling approach display 400 presents graphical elements and text associated with circling approach data 402 when the aircraft is positioned inside the circling boundary (see FIG. 3, reference 310). From inside the circling boundary, the circling approach data 402 includes a restricted region 404, or in other words, the non-flyable region of the circling boundary (see FIG. 3, reference 306). The restricted region 404 view, as shown, is presented via Synthetic Vision System (SVS) when the aircraft is inside the circling boundary. The circling approach data 402 further includes the circling boundary 406, the Minimum Descent Altitude (MDA) 408, and an indication of the distance 410 to the optimal runway from the current aircraft position. The circling approach data 402 is presented as graphical elements and text onboard the aircraft, to provide flight crew members with improved situational awareness during performance of a circle-to-land procedure.

Figure 5:
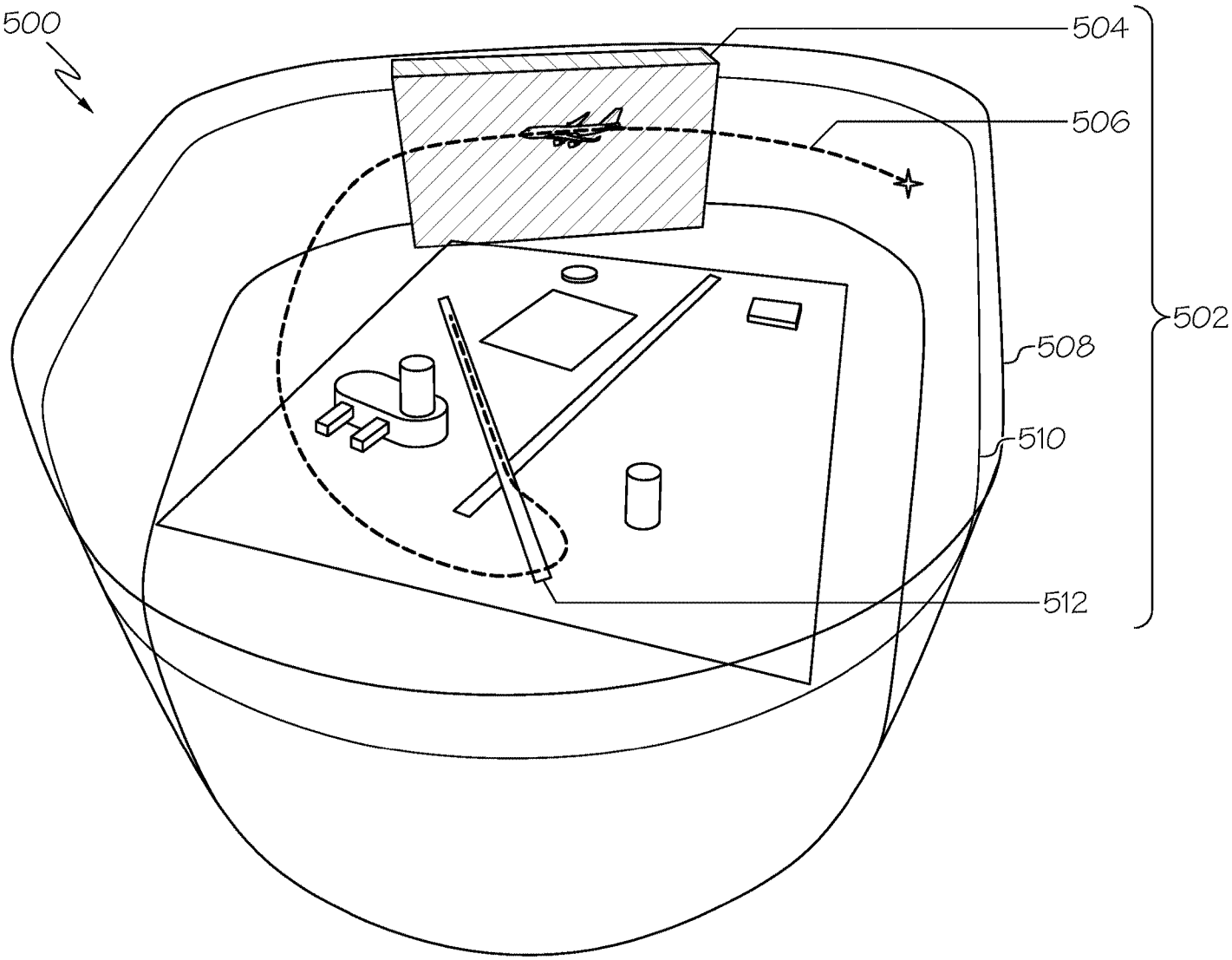
FIG. 5 is a three-dimensional (3D) approach preview display, in accordance with the disclosed embodiments.

FIG. 5 is a three-dimensional (3D) approach preview display 500, in accordance with the disclosed embodiments. Here, the circling approach display presents 3D graphical elements and text associated with circling approach data 502. The circling approach data 502 includes a restricted region 504, or in other words, the non-flyable region of the circling boundary (see FIG. 3, reference 306 and FIG. 4, reference 404). The circling approach data 502 further includes a probable circling path 506 from a missed approach point, a circling boundary minimum decision height 508, a visual reference point altitude 510, and an optimal runway 512. The circling approach data 502 is presented as 3D graphical elements and text onboard the aircraft, to provide flight crew members with improved situational awareness during performance of a circle-to-land procedure.

Figure 6:
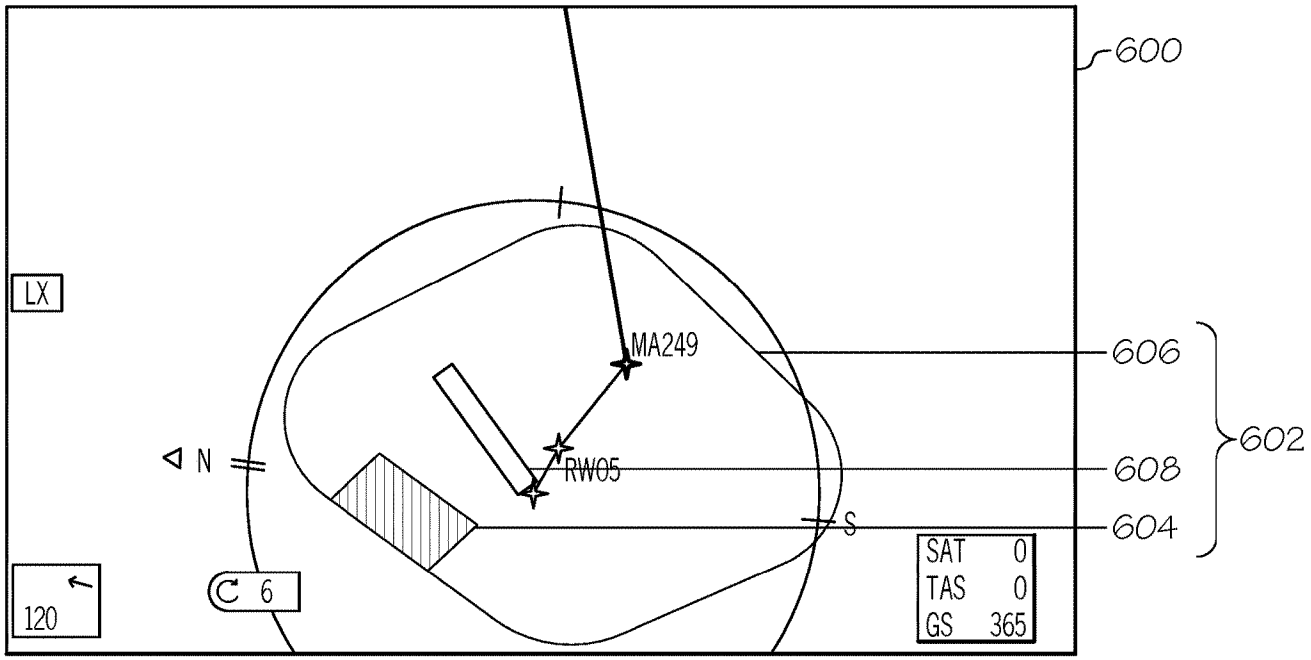
FIG. 6 is an active circling approach presentation via a two-dimensional (2D) aircraft onboard display, in accordance with the disclosed embodiments.

FIG. 6 is an active circling approach presentation 600 via a two-dimensional (2D) aircraft onboard display, in accordance with the disclosed embodiments. It should be appreciated that the 2D circling approach presentation 600 represents a two-dimensional embodiment of the 3D approach preview display 500 of FIG. 5. In this way, the 2D aircraft onboard display presents similar graphical elements as those illustrated in FIG. 5, but in a "flat" and 2D form. The circling approach data 602 includes a restricted region 604, or in other words, the non-flyable region of the circling boundary (see FIG. 3, reference 306; FIG. 4, reference 404; FIG. 5, reference 504). The circling approach data 602 further includes a circling boundary 606 and an optimal runway 608. The circling approach data 602 is presented as 2D graphical elements and text onboard the aircraft, to provide flight crew members with improved situational awareness during performance of a circle-to-land procedure.

Figure 7:
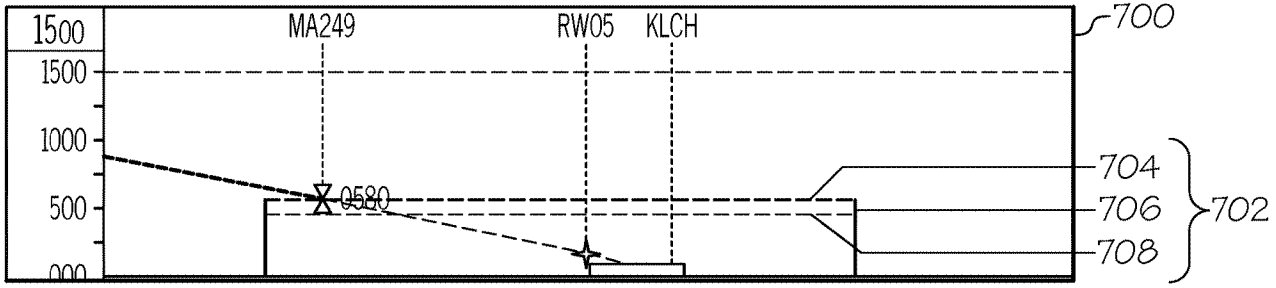
FIG. 7 is an active circling approach presentation via a Vertical Situation Display (VSD), in accordance with the disclosed embodiments.

FIG. 7 is an active circling approach presentation 700 via a Vertical Situation Display (VSD), in accordance with the disclosed embodiments. It should be appreciated that the circling approach presentation 700 represents a VSD-compatible embodiment of the 3D approach preview display 500 of FIG. 5, the 2D circling approach presentation 600 of FIG. 6, and the Synthetic Vision System (SVS) circling approach display 300, 400 of FIGS. 3-4. In this way, the circling approach presentation 700 presents similar graphical elements as those illustrated in FIGS. 3-6, but in a form compatible with an aircraft onboard VSD. The circling approach data 702 includes a Minimum Descent Altitude (MDA) 704, a circling boundary 706 per vertical limits, and a visual reference point 708. The circling approach data 702 is presented as VSD-compatible graphical elements and text onboard the aircraft, to provide flight crew members with improved situational awareness during performance of a circle-to-land procedure.

Figure 8:
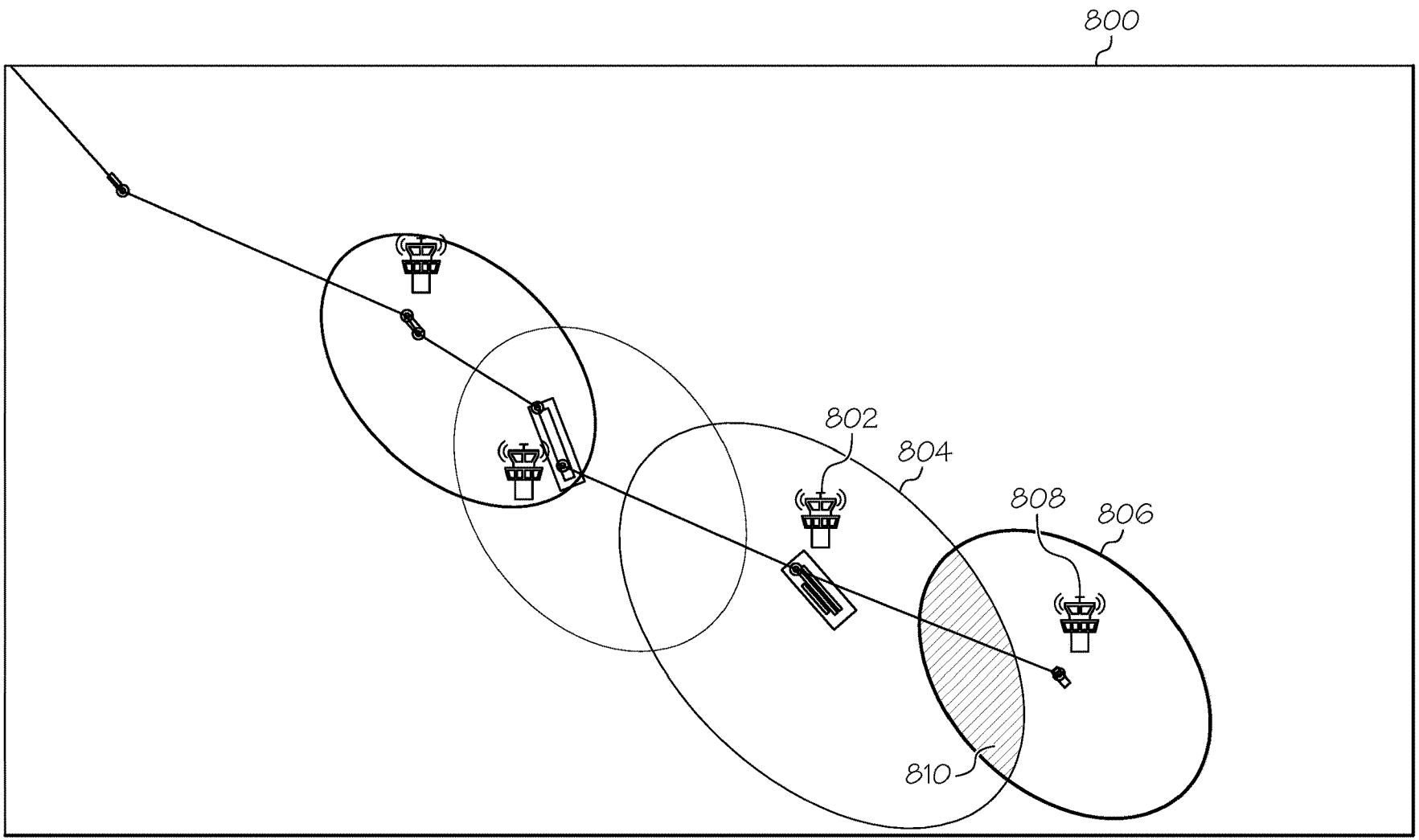
FIG. 8 is a diagram of an airport with circling boundary conflicts, in accordance with the disclosed embodiments.

FIG. 8 is a diagram 800 of a first airport 802 with circling boundary conflicts, in accordance with the disclosed embodiments. When a first aircraft is attempting to perform a circling approach at the first airport 802, the circling approach system (see FIGS. 1-2) identifies circling boundary conflicts based on traffic information for nearby, secondary airports. A secondary airport is considered "nearby" or "in close proximity" to the first airport 802 when the secondary airport is within twice the circling boundary of the first airport 802 associated with the first aircraft.

When determining whether performing a circle-to-land procedure is appropriate for a first aircraft associated with the first airport 802, the estimated time of arrival and/or the estimated time of departure of external, secondary aircraft associated with nearby, secondary airports is considered. As shown, a first circling boundary 804 is associated with the first airport 802, and a second circling boundary 806 is associated with a second airport 808. For purposes of this example, the second airport 808 is within twice the first circling boundary 804, or in other words, when the area of the first circling boundary 804 is doubled (i.e., multiplied by a factor of two) to generate a doubled area, then the second airport 808 is located in the doubled area. The first circling boundary 804 and the second circling boundary 806 share an overlapping region of airspace 810, which may present traffic conflicts for aircraft attempting to perform circling approaches at the first airport 802 and/or the second airport 808.

Figure 9:
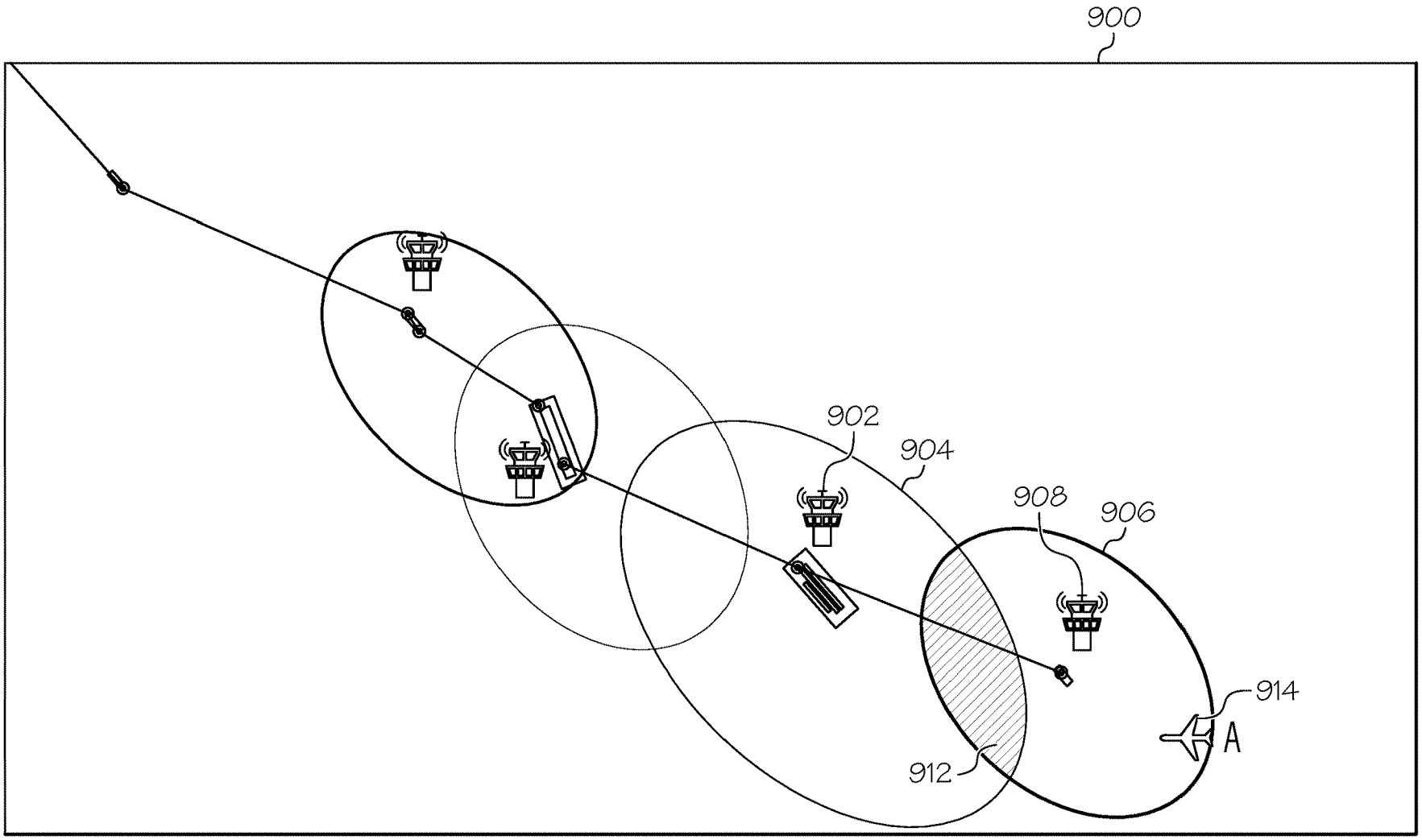
FIG. 9 is a diagram of an aircraft entering a circling boundary of an airport with circling boundary conflicts, in accordance with the disclosed embodiments.

FIG. 9 is a diagram 900 of a second aircraft 914 entering a second circling boundary 906 of a second airport 908 with circling boundary conflicts, in accordance with the disclosed embodiments. As shown, the first airport 902 is surrounded by the first circling boundary 904, the second airport 908 is surrounded by the second circling boundary 906, and the first airport 902 and the second airport 908 share an overlapping region of airspace 912 that is included as part of the first circling boundary 904 and the second circling boundary 906. A second aircraft 914 has entered the second circling boundary 906 of the second airport 908. In this scenario, the second aircraft 914 is not under any restriction under which performing a circling approach at the second airport would necessarily be postponed due to conflicting traffic.

Figure 10:
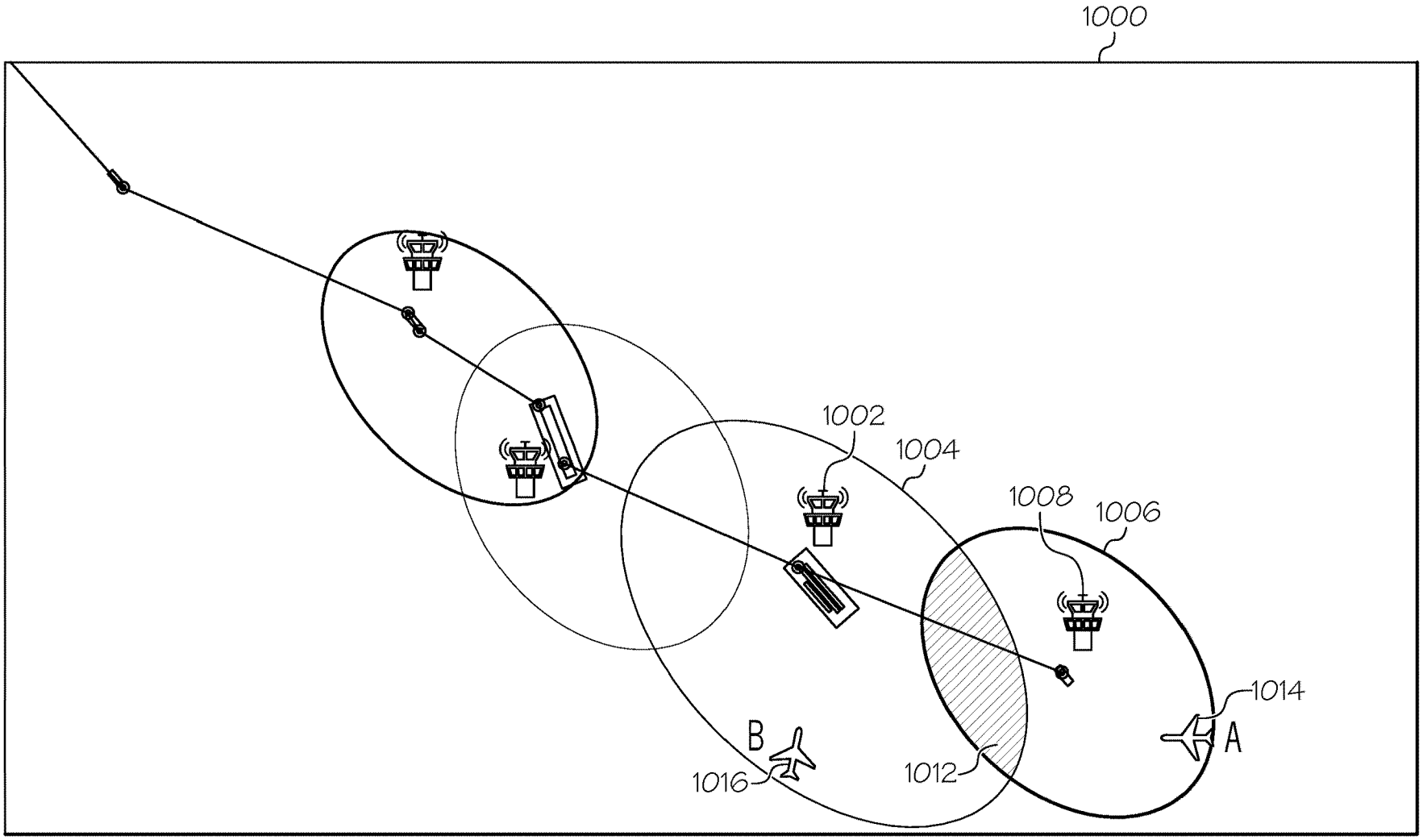
FIG. 10 is a diagram of a temporary restricted zone for an airport with circling boundary conflicts, in accordance with the disclosed embodiments.

FIG. 10 is a diagram 1000 of a temporary restricted zone for a second airport 1008 with circling boundary conflicts, in accordance with the disclosed embodiments. As shown, the first airport 1002 is surrounded by the first circling boundary 1004, the second airport 1008 is surrounded by the second circling boundary 1006, and the first airport 1002 and the second airport 1008 share an overlapping region of airspace 1012 that is included as part of the first circling boundary 1004 and the second circling boundary 1006. A second aircraft 1014 has entered the second circling boundary 1006 of the second airport 1008, and a first aircraft 1016 has entered the first circling boundary 1004 of the first airport 1002. In this scenario, the overlapping region of airspace 1012 is restricted from use by the second aircraft 1014 until the first aircraft 1016 has landed at the first airport 1002. Here, the second aircraft 1014 is performing a circling approach toward the second airport, but once the first aircraft 1016 enters the first circling boundary 1004, then the second aircraft 1014 is under restriction from using the overlapping region of airspace 1012 to perform a circling approach at the second airport 1008. Thus, the circling approach for the second aircraft 1014 is postponed due to conflicting traffic.

Figure 11:
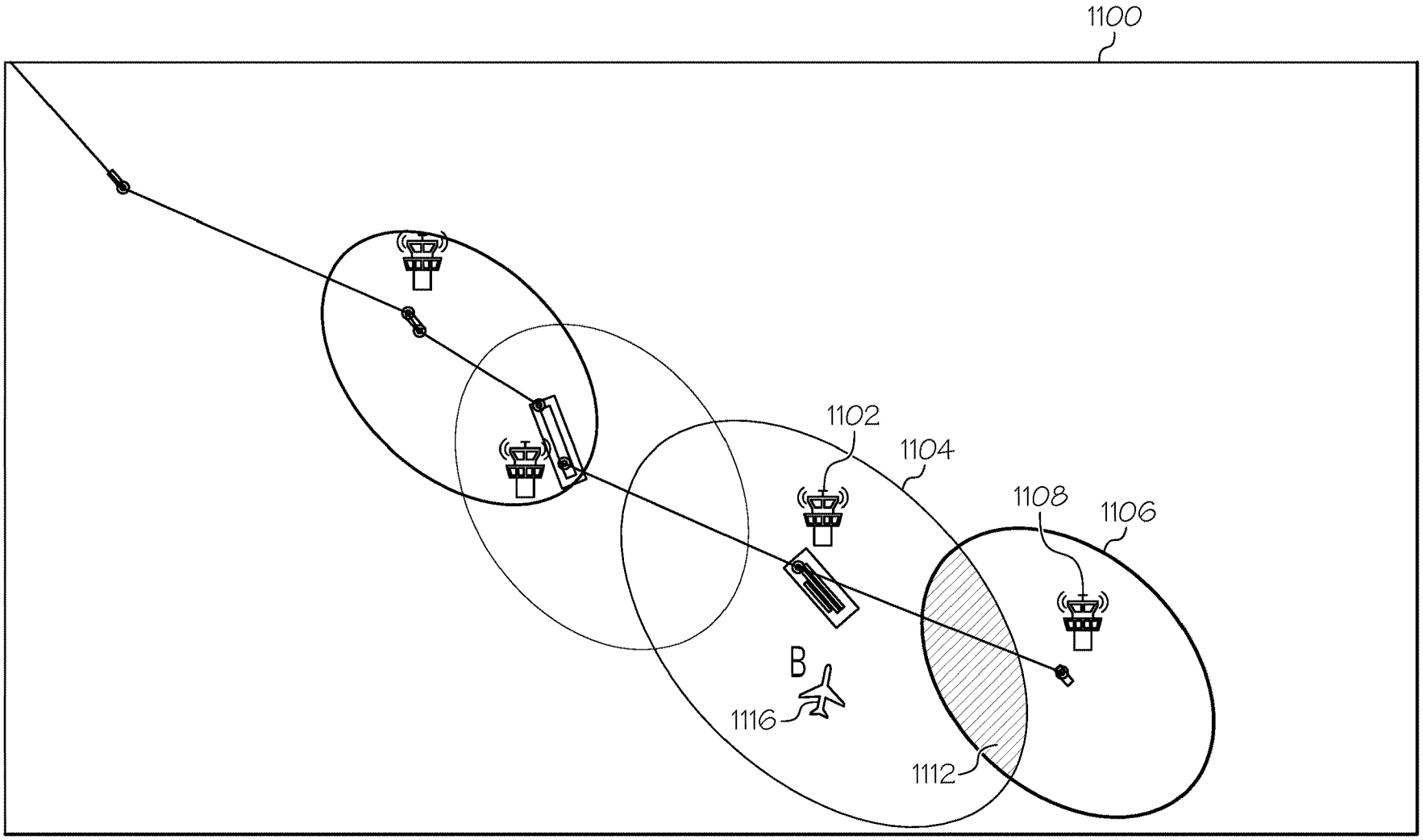
FIG. 11 is a diagram of removal of a temporary restricted zone for an airport with circling boundary conflicts, based on aircraft landing, in accordance with the disclosed embodiments.

FIG. 11 is a diagram of removal of a temporary restricted zone for an airport with circling boundary conflicts, based on aircraft landing, in accordance with the disclosed embodiments. Like FIGS. 9-10, the first airport 1102 is surrounded by the first circling boundary 1104, the second airport 1108 is surrounded by the second circling boundary 1106, and the first airport 1102 and the second airport 1108 share an overlapping region of airspace 1112 that is included as part of the first circling boundary 1104 and the second circling boundary 1106. As shown, the second aircraft (see FIG. 10, reference 1014) has landed, and is no longer in-flight in the second circling boundary 1106 of the second airport 1108. However, the first aircraft 1116 continues to fly inside the first circling boundary 1104 of the first airport 1102. In this scenario, the restriction from using the overlapping region of airspace 1112 is lifted, and thus the first aircraft 1116 is permitted to perform a circling approach at the first airport 1102. Here, the second aircraft has already landed at the second airport 1108 after performing a circling approach toward the second airport 1108, and once the second aircraft landed, the restriction from using the overlapping region of airspace 1112 to perform a circling approach was removed. Thus, the circling approach for the first aircraft 1116 is permitted, and is no longer postponed due to conflicting traffic.

Figure 12:
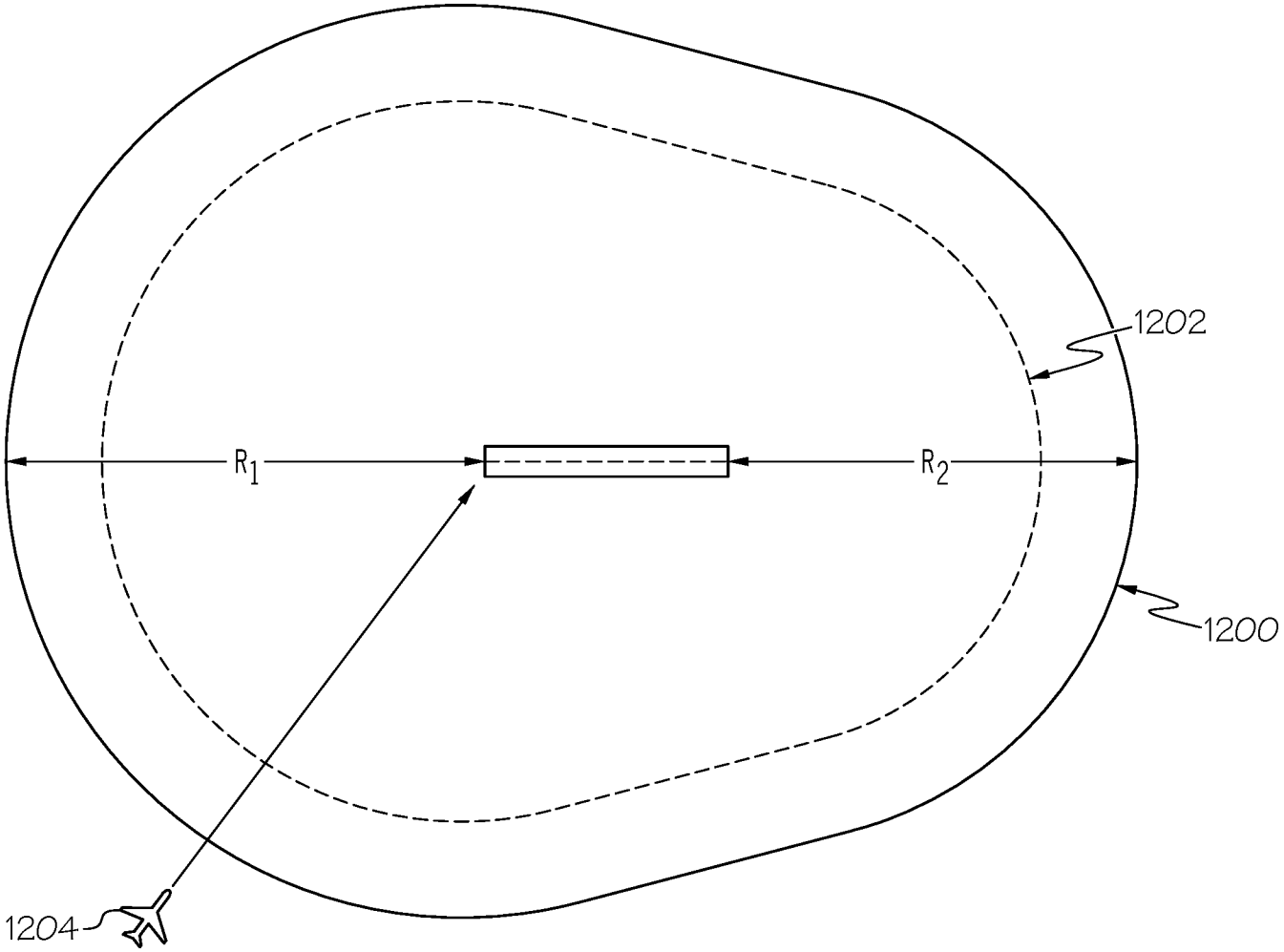
FIG. 12 is a diagram of a circling boundary for an aircraft, in accordance with the disclosed embodiments.

FIG. 12 is a diagram of a circling boundary 1200 for an aircraft 1204, in accordance with the disclosed embodiments. The circling boundary 1200 is the boundary of a circle to land approach for the aircraft 1204. As shown, the circling boundary 1200 includes an inner circle 1202. The inner circle 1202 is the zone by which a pilot begins a 180° turn to avoid overshooting the circling boundary 1200 at a current speed of the aircraft 1204. In other words, it is safe to initiate a 180° turn within the inner circle 1202.

Figure 13:
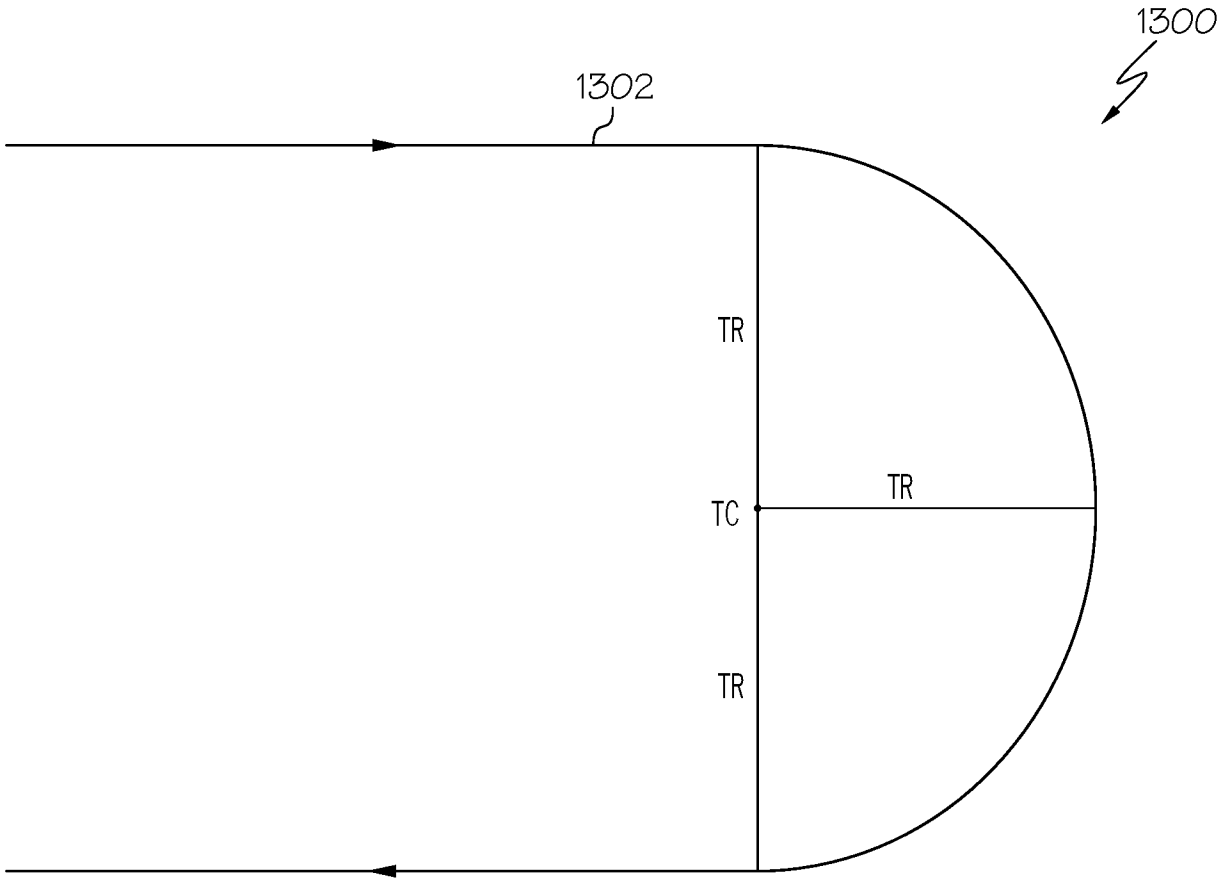
FIG. 13 is a diagram of overshoot alert computations for an aircraft circling boundary, in accordance with the disclosed embodiments.
Figure 14:
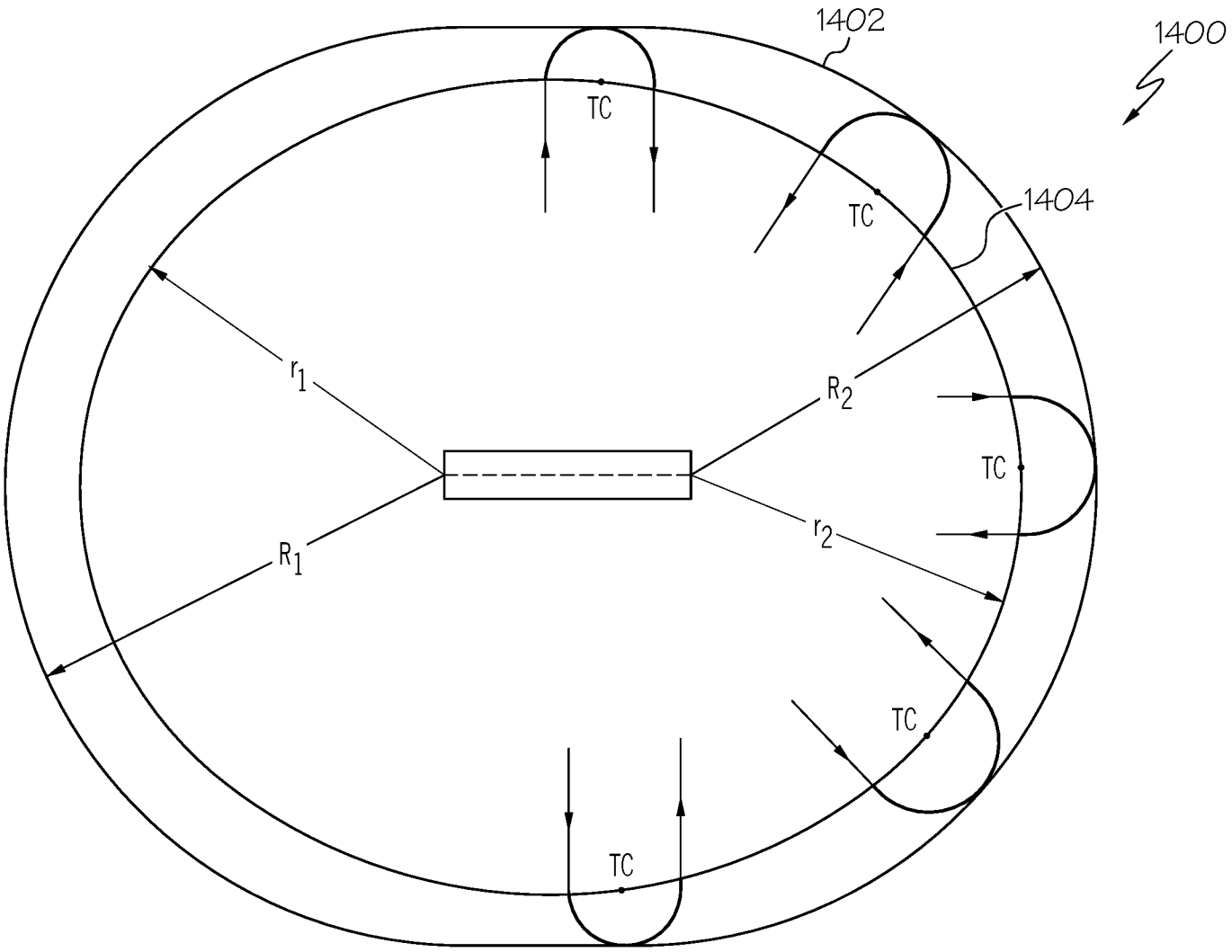
FIG. 14 is a diagram of loci of radii to detect potential overshoot for an aircraft circling boundary, in accordance with the disclosed embodiments.

FIG. 13 is a diagram 1300 of overshoot alert computations for an aircraft circling boundary, in accordance with the disclosed embodiments. FIG. 13 illustrates an aircraft flight path 1302 while performing a 180° turn. Applicable parameters include a maximum course change, a maximum speed, and a maximum bank angle. The maximum course change which the pilot needs to perform inside the circling zone is 180°. The maximum speed which the aircraft can fly is Vg. The maximum bank angle for the aircraft is 30°. For making a 180° turn, the distance required is the turn radius (TR), and TR is computed using the following equation: $TR=Vg2/(g\times \text{Tan}\ \emptyset)$, wherein TR is computed at all points throughout the circle. Thus, the distance which the aircraft can turn to accomplish the 180° turn is the turn radius distance. (TR). This is depicted by the inner circle(r), wherein $r=R-TR$. FIG. 14 illustrates the computation of potential overshoot using multiple flight paths (see FIG. 13, reference 1302) throughout the circling boundary 1402. The circling boundary 1402 includes an inner circle 1404, as described previously with regard to FIG. 12 (see reference 1202). Here, the computations described with regard to FIG. 13 are performed for a plurality of flight paths within the circling boundary 1402, and the circling approach system described herein provides an overshoot alert prior to the aircraft crossing the r1 distance (i.e., the inner circle 1404 radius). Thus, FIG. 14 illustrates a diagram 1400 of loci of radii to detect potential overshoot for an aircraft circling boundary, in accordance with the disclosed embodiments.

Figure 15:
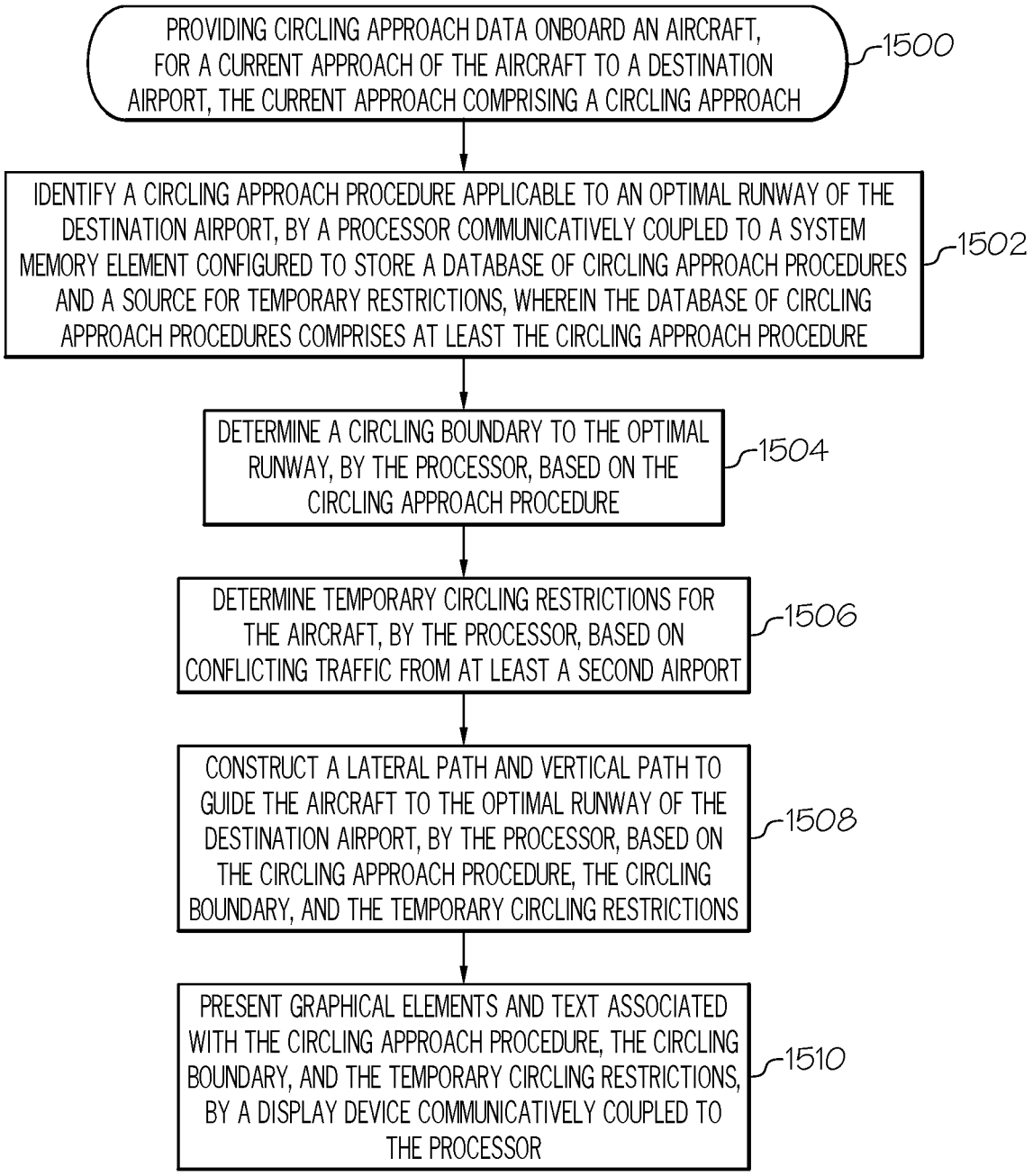
FIG. 15 is a flowchart that illustrates an embodiment of a process for providing circling approach data onboard an aircraft, for a current approach of the aircraft to a destination airport, wherein the current approach comprises a circling approach, in accordance with the disclosed embodiments.

FIG. 15 is a flowchart that illustrates an embodiment of a process 1500 for providing circling approach data onboard an aircraft, for a current approach of the aircraft to a destination airport, wherein the current approach comprises a circling approach, in accordance with the disclosed embodiments. First, the process 1500 identifies a circling approach procedure applicable to an optimal runway of the destination airport, by a processor communicatively coupled to a system memory element configured to store a database of circling approach procedures and a source for temporary restrictions, wherein the database of circling approach procedures comprises at least the circling approach procedure (step 1502). A circling approach is a maneuver initiated by flight crew of the aircraft to align the aircraft with a runway for landing when a straight-in landing from an instrument approach is not possible or desirable. Here, the process 1500 determines the appropriate aircraft maneuvers such that the aircraft may perform a circle-to-land operation to land on the optimal runway.

The process 1500 then determines a circling boundary to the optimal runway, by the processor, based on the circling approach procedure (step 1504). The circling boundary is a boundary of protected airspace for a circling approach, which is usually defined by arcs drawn from the threshold of each runway at an airport. The process 1500 determines the circling boundary applicable to the circling approach procedure for the optimal runway.

The process 1500 also determines temporary circling restrictions for the aircraft, by the processor, based on conflicting traffic from at least a second airport (step 1506). One suitable methodology for determining temporary circling restrictions is described below with reference to FIG. 17. Temporary circling restrictions prevent the aircraft from entering airspace which may be entered and/or occupied by secondary aircraft traffic, thereby preventing collision of the aircraft with such secondary aircraft.

Next, the process 1500 constructs a lateral path and a vertical path to guide the aircraft to the optimal runway of the destination airport, by the processor, based on the circling approach procedure, the circling boundary, and the temporary circling restrictions (step 1508). One suitable methodology for constructing a lateral path and a vertical path is described below with reference to FIG. 16. The destination airport is a predetermined airport toward which the aircraft is traveling, as part of a preconfigured flight plan. The optimal runway is the most favorable runway (of all of the available runways at the destination airport) for the aircraft to land, based on current conditions of the aircraft and the airport. Here, the process 1500 computes flight guidance, including a lateral flight path and a vertical flight path, from a current position of the aircraft to land at the optimal runway. Exemplary embodiments of the process 1500 compute the lateral path and the vertical path via a Flight Management System (FMS). Other embodiments of the process 1500 compute the lateral path and the vertical path via a computing device that is separate and distinct from the FMS onboard the aircraft.

The process 1500 presents graphical elements and text associated with the circling approach procedure, the circling boundary, and the temporary circling restrictions (step 1510). Generally, the process 1500 presents the graphical elements and text via an aircraft onboard display and/or a computing device display that external to the integrated aircraft avionics and systems. The graphical elements and text associated with the circling approach may include, without limitation, representations of the destination airport, the optimal runway, the lateral path, the vertical path, and the circling boundary associated with the optimal runway. In some embodiments, the graphical elements and text associated with the circling approach further represent a missed approach point, a non-flyable region of the circling boundary, and a minimum decision altitude.

In certain embodiments, the process 1500 monitors a current trend of the aircraft inside the circling boundary; and presents a visual representation of the current trend, by the display device, wherein the graphical elements and text comprise the visual representation of the current trend. In some embodiments, the process 1500 identifies a distance to the optimal runway; and presents a visual representation of the distance to the optimal runway, by the display device, wherein the graphical elements and text comprise the visual representation of the distance. In some embodiments, the process 1500 predicts a potential violation of protected airspace covered by the circling boundary, by the processor; and provides multi-modal alerts based on the potential violation, onboard the aircraft.

In certain embodiments, the process 1500 is triggered after identification of the current approach procedure as a circling approach. In this case, the process 1500 determines whether the current approach for the destination airport comprises the circling approach and a circling Minimum Descent Altitude (MDA), based on published approach chart data; and in response to determining that the current approach comprises the circling approach, constructs the lateral path and the vertical path; identifies the circling approach procedure; determines the circling boundary and the temporary circling restrictions; and presents the graphical elements and text.

Figure 16:
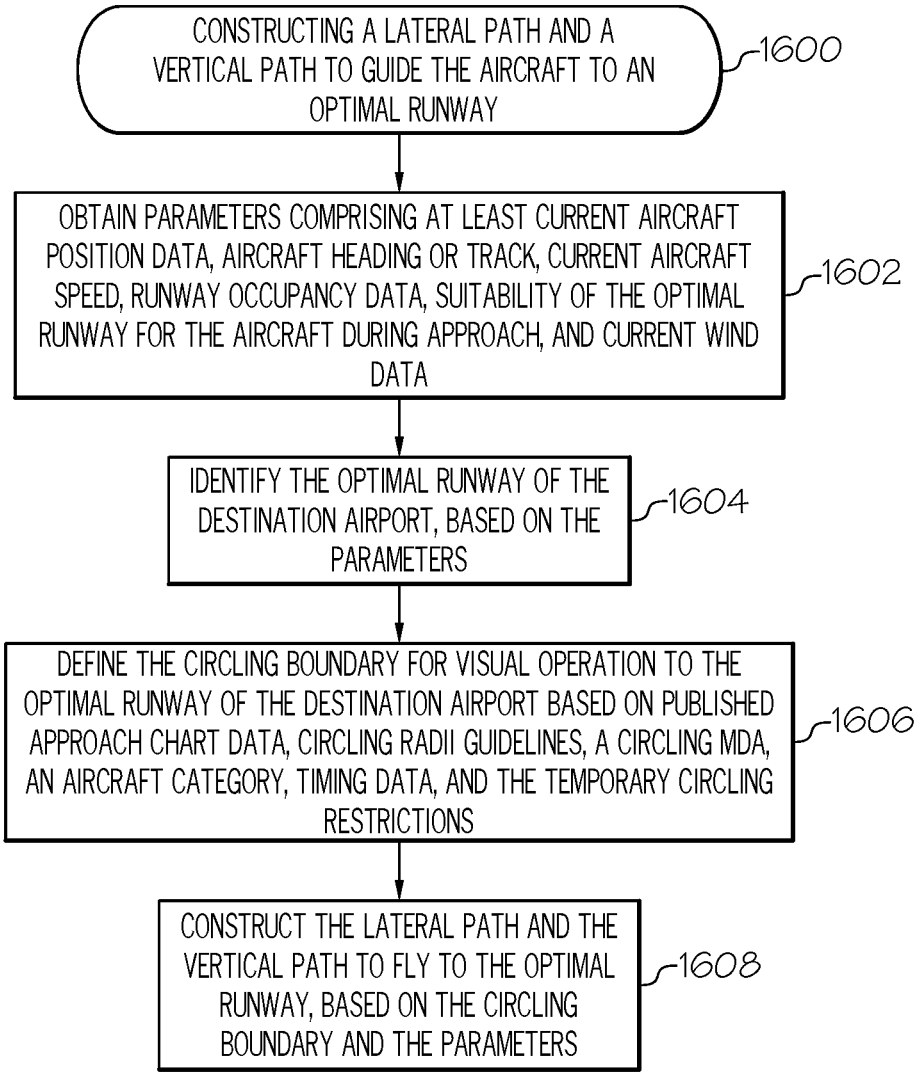
FIG. 16 is a flowchart that illustrates an embodiment of a process for constructing a lateral path and a vertical path to guide the aircraft to an optimal runway, in accordance with the disclosed embodiments.

FIG. 16 is a flowchart that illustrates an embodiment of a process 1600 for constructing a lateral path and a vertical path to guide the aircraft to an optimal runway, in accordance with the disclosed embodiments. It should be appreciated that the process 1600 described in FIG. 16 represents one embodiment of step 1508 described above in the discussion of FIG. 15, including additional detail.

First, the process 1600 obtains parameters comprising at least current aircraft position data, a current aircraft heading or track, current aircraft speed, runway data, and current wind data (step 1602). The process 1600 obtains the parameters using aircraft onboard sensor data and aircraft onboard avionics and instrumentation data. Additionally, the process 1600 obtains parameter data from one or more remotely located servers that store relevant navigation data, obstacle data, Notices to Airmen (NOTAMs), and the like. Next, the process 1600 identifies the optimal runway of the destination airport, based on the parameters (step 1604). The optimal runway is the most favorable runway (of all of the available runways at the destination airport) for the aircraft to land, based on current conditions of the aircraft and the airport.

The process 1600 then defines the circling boundary for visual operation to the optimal runway of the destination airport based on published approach chart data, circling radii guidelines, a circling Minimum Descent Altitude (MDA), an aircraft category, timing data, and the temporary circling restrictions (step 1606). The process 1600 constructs the lateral path and the vertical path to fly to the optimal runway, based on the circling boundary and the parameters (step 1608).

Figure 17:
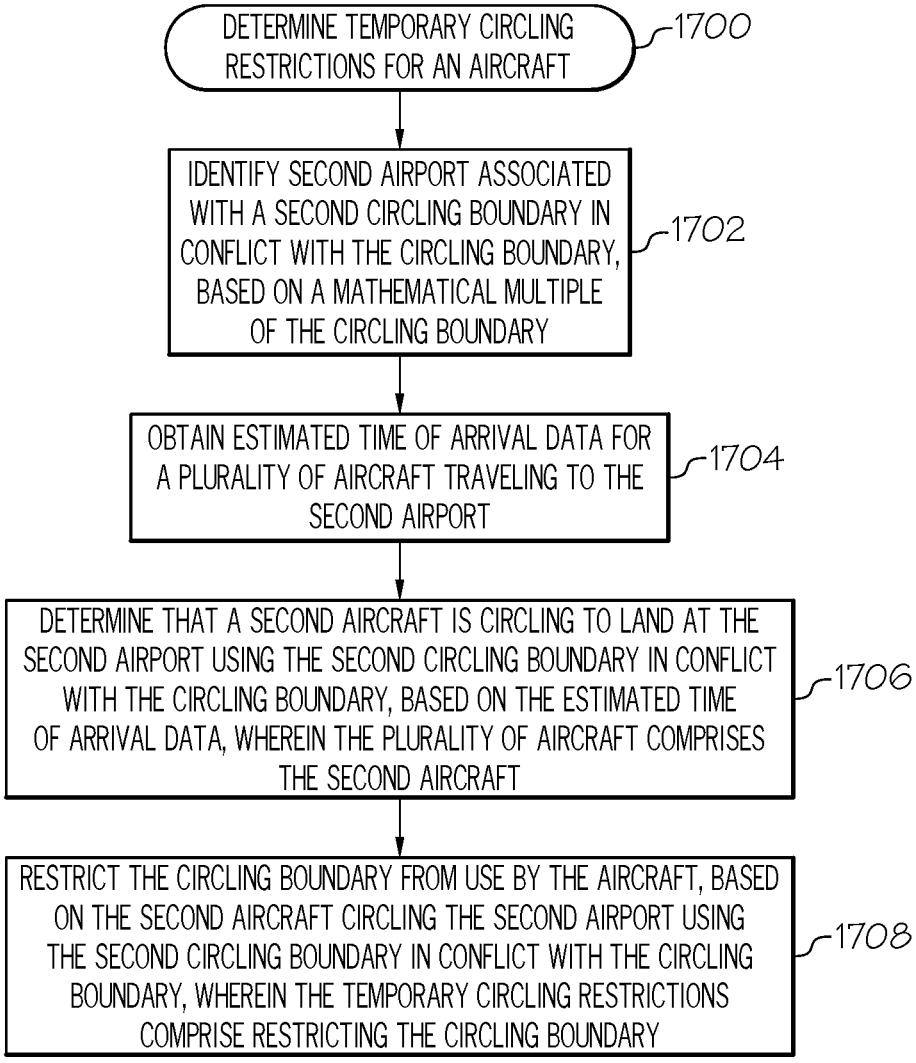
FIG. 17 is a flowchart that illustrates an embodiment of a process for determining temporary circling restrictions for an aircraft, in accordance with the disclosed embodiments.

FIG. 17 is a flowchart that illustrates an embodiment of a process 1700 for determining temporary circling restrictions for an aircraft, in accordance with the disclosed embodiments. It should be appreciated that the process 1700 described in FIG. 17 represents one embodiment of step 1506 described above in the discussion of FIG. 15, including additional detail.

The process 1700 identifies the second airport associated with a second circling boundary in conflict with the circling boundary, based on a mathematical multiple of the circling boundary (step 1702). Circling boundaries for airports in close proximity to each other may overlap. In other words, a first airport includes a first circling boundary, a second airport includes a second circling boundary, and the first circling boundary and the second circling boundary each include one shared and overlapping region of airspace. The process 1700 obtains estimated time of arrival data for a plurality of aircraft traveling to the second airport (step 1704). Estimated time of arrival data may be obtained from a remotely located storage location (e.g., a remote server system), or from communications with ground control dynamically obtained during flight of the aircraft.

The process 1700 determines that a second aircraft is circling the second airport using the second circling boundary in conflict with the circling boundary, based on the estimated time of arrival data, wherein the plurality of aircraft comprises the second aircraft (step 1706), and the process 1700 then restricts the circling boundary from use by the aircraft, based on the second aircraft circling the second airport using the second circling boundary in conflict with the circling boundary, wherein the temporary circling restrictions comprise restricting the circling boundary (step 1708). Here, the process 1700 determines that the circle-to-land positioning of the first aircraft may potentially conflict with the circle-to-land positioning of the second aircraft. Thus, the process 1700 determines that a potential collision may occur between the aircraft and the second aircraft, due to the existence of both the first aircraft and the second aircraft located inside airspace boundaries that include shared airspace.

In certain embodiments, the process 1700 restricts the circling boundary based on more than one aircraft and/or more than one conflicting circling boundary associated with more than one nearby airport. Here, the process 1700 identifies at least a second airport associated with a circling boundary in conflict with the ownship circling boundary, based on a mathematical multiple of the circling boundary; obtains estimated time of arrival data for a plurality of aircraft traveling to the one or more secondary airports; determines that at least one secondary aircraft is circling the one or more secondary airports, based on the estimated time of arrival data, wherein the plurality of aircraft comprises the at least one secondary aircraft; and restricts the circling boundary from use by the ownship aircraft, based on the at least one secondary aircraft circling the other airport (i.e., the one or more secondary airports), wherein the temporary circling restrictions comprise restricting the circling boundary.

The various tasks performed in connection with processes 1500-1700 may be performed by software, hardware, firmware, or any combination thereof. For illustrative purposes, the preceding descriptions of processes 1500-1700 may refer to elements mentioned above in connection with FIGS. 1-14. In practice, portions of processes 1500-1700 may be performed by different elements of the described system. It should be appreciated that processes 1500-1700 may include any number of additional or alternative tasks, the tasks shown in FIGS. 15-17 need not be performed in the illustrated order, and processes 1500-1700 may be incorporated into a more comprehensive procedure or process having additional functionality not described in detail herein. Moreover, one or more of the tasks shown in FIGS. 15-17 could be omitted from embodiments of the processes 1500-1700 as long as the intended overall functionality remains intact.

Techniques and technologies may be described herein in terms of functional and/or logical block components, and with reference to symbolic representations of operations, processing tasks, and functions that may be performed by various computing components or devices. Such operations, tasks, and functions are sometimes referred to as being computer-executed, computerized, software-implemented, or computer-implemented. In practice, one or more processor devices can carry out the described operations, tasks, and functions by manipulating electrical signals representing data bits at memory locations in the system memory, as well as other processing of signals. The memory locations where data bits are maintained are physical locations that have particular electrical, magnetic, optical, or organic properties corresponding to the data bits. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

When implemented in software or firmware, various elements of the systems described herein are essentially the code segments or instructions that perform the various tasks. The program or code segments can be stored in a processor-readable medium or transmitted by a computer data signal embodied in a carrier wave over a transmission medium or communication path. The "computer-readable medium", "processor-readable medium", or "machine-readable medium" may include any medium that can store or transfer information. Examples of the processor-readable medium include an electronic circuit, a semiconductor memory device, a ROM, a flash memory, an erasable ROM (EROM), a floppy diskette, a CD-ROM, an optical disk, a hard disk, a fiber optic medium, a radio frequency (RF) link, or the like. The computer data signal may include any signal that can propagate over a transmission medium such as electronic network channels, optical fibers, air, electromagnetic paths, or RF links. The code segments may be downloaded via computer networks such as the Internet, an intranet, a LAN, or the like.

The preceding description refers to elements or nodes or features being "connected" or "coupled" together. As used herein, unless expressly stated otherwise, "coupled" means that one element/node/feature is directly or indirectly joined to (or directly or indirectly communicates with) another element/node/feature, and not necessarily mechanically. Likewise, unless expressly stated otherwise, "connected" means that one element/node/feature is directly joined to (or directly communicates with) another element/node/feature, and not necessarily mechanically. Thus, although the schematic shown in FIG. 2 depicts one exemplary arrangement of elements, additional intervening elements, devices, features, or components may be present in an embodiment of the depicted subject matter.

For the sake of brevity, conventional techniques related to signal processing, data transmission, signaling, network control, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

Some of the functional units described in this specification have been referred to as "modules" in order to more particularly emphasize their implementation independence. For example, functionality referred to herein as a module may be implemented wholly, or partially, as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices, or the like. Modules may also be implemented in software for execution by various types of processors. An identified module of executable code may, for instance, comprise one or more physical or logical modules of computer instructions that may, for instance, be organized as an object, procedure, or function. Nevertheless, the executables of an identified module need not be physically located together, but may comprise disparate instructions stored in different locations that, when joined logically together, comprise the module and achieve the stated purpose for the module. Indeed, a module of executable code may be a single instruction, or many instructions, and may even be distributed over several different code segments, among different programs, and across several memory devices. Similarly, operational data may be embodied in any suitable form and organized within any suitable type of data structure. The operational data may be collected as a single data set, or may be distributed over different locations including over different storage devices, and may exist, at least partially, merely as electronic signals on a system or network.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A method for providing circling approach data onboard an aircraft, the method comprising:

for a current approach of the aircraft to a destination airport, the current approach comprising a circling approach, identifying a circling approach procedure applicable to an optimal runway of the destination airport, by a processor communicatively coupled to a system memory element configured to store a database of circling approach procedures and a source for temporary restrictions, wherein the database of circling approach procedures comprises at least the circling approach procedure;

determining a circling boundary to the optimal runway, by the processor, based on the circling approach procedure;

determining temporary circling restrictions for the aircraft, by the processor, based on conflicting traffic from at least a second airport;

constructing a lateral path and a vertical path to guide the aircraft to the optimal runway of the destination airport, by the processor, based on the circling approach procedure, the circling boundary, and the temporary circling restrictions; and presenting graphical elements and text associated with the circling approach procedure, the circling boundary, and the temporary restrictions, by a display device communicatively coupled to the processor, wherein determining the temporary circling restrictions comprises:

identifying the second airport associated with a second circling boundary in conflict with the circling boundary, based on a mathematical multiple of the circling boundary;

obtaining estimated time of arrival data for a plurality of aircraft traveling to the second airport;

determining that a second aircraft is circling to land at the second airport using the second circling boundary in conflict with the circling boundary, based on the estimated time of arrival data, wherein the plurality of aircraft comprises the second aircraft and restricting the circling boundary from use by the aircraft, based on the second aircraft circling the second airport using the second circling boundary in conflict with the circling boundary, wherein the temporary circling restrictions comprise restricting the circling boundary.

2. The method of claim 1, wherein constructing the lateral path and the vertical path further comprises:

obtaining parameters comprising at least current aircraft position data, aircraft heading, current aircraft speed, runway data, runway condition data, runway occupancy data, suitability of the optimal runway for the aircraft during approach, and current wind data, by the processor; and identifying the optimal runway of the destination airport, by the processor, based on the parameters.

3. The method of claim 2, wherein constructing the lateral path and the vertical path further comprises:

defining, by the processor, the circling boundary for visual operation to the optimal runway of the destination airport based on published approach chart data, circling radii guidelines, a circling Minimum Descent Altitude (MDA), aircraft category, timing data, and the temporary circling restrictions; and constructing the lateral path and the vertical path to fly to the optimal runway, by the processor, based on the circling boundary and the parameters.

4. The method of claim 1, wherein the graphical elements and text associated with the circling approach represent the destination airport, the optimal runway, the lateral path, the vertical path, and the circling boundary associated with the optimal runway.

5. The method of claim 4, wherein the graphical elements and text associated with the circling approach further represent a missed approach point, a non-flyable region of the circling boundary, and a minimum decision altitude.

6. The method of claim 1, further comprising:

monitoring a current trend of the aircraft inside the circling boundary; and presenting a visual representation of the current trend, by the display device, wherein the graphical elements and text comprise the visual representation of the current trend.

7. The method of claim 1, further comprising:

identifying a distance to the optimal runway; and presenting a visual representation of the distance to the optimal runway, by the display device, wherein the graphical elements and text comprise the visual representation of the distance.

8. The method of claim 1, further comprising:

predicting a potential violation of protected airspace covered by the circling boundary, by the processor; and providing multi-modal alerts based on the potential violation, onboard the aircraft.

9. The method of claim 1, further comprising:

determining whether the current approach for the destination airport comprises the circling approach and a circling Minimum Descent Altitude (MDA), based on published approach chart data; and in response to determining that the current approach comprises the circling approach, constructing the lateral path and the vertical path;

identifying the circling approach procedure;

determining the circling boundary and the temporary circling restrictions; and presenting the graphical elements and text.

10. A system for providing circling approach data onboard an aircraft, the system comprising:

a system memory element configured to store a database of circling approach procedures and a source for temporary restrictions;

a display device, configured to present a visual representation of the circling approach data; and at least one processor communicatively coupled to the system memory element and the display device, the at least one processor configured to:

for a current approach of the aircraft to a destination airport, the current approach comprising a circling approach, identify a circling approach procedure applicable to an optimal runway of the destination airport, wherein the database of circling approach procedures comprises at least the circling approach procedure;

determine a circling boundary to the optimal runway, based on the circling approach procedure;

determine temporary circling restrictions for the aircraft, based on conflicting traffic from at least a second airport;

construct a lateral path and a vertical path to guide the aircraft to the optimal runway of the destination airport, based on the circling approach procedure, the circling boundary, and the temporary circling restrictions; and present graphical elements and text associated with the circling approach procedure, the circling boundary, and the temporary circling restrictions, via the display device, wherein the at least one processor is further configured to determine the temporary circling restrictions for the aircraft, based on conflicting traffic from an airport, by:

identifying the second airport associated with a second circling boundary in conflict with the circling boundary, based on a mathematical multiple of the circling boundary;

obtaining estimated time of arrival data for a plurality of aircraft traveling to the second airport;

determining that a second aircraft is circling to land at the second airport using the second circling boundary in conflict with the circling boundary, based on the estimated time of arrival data, wherein the plurality of aircraft comprises the second aircraft and restricting the circling boundary from use by the aircraft, based on the second aircraft circling the second airport using the second circling boundary in conflict with the circling boundary, wherein the temporary circling restrictions comprise restricting the circling boundary.

11. The system of claim 10, wherein the at least one processor is further configured to construct the lateral path and the vertical path, by:

obtaining parameters comprising at least current aircraft position data, aircraft heading, current aircraft speed, runway data, runway condition data, runway occupancy data, suitability of the optimal runway for the aircraft during approach, and current wind data; and identifying the optimal runway of the destination airport, based on the parameters.

12. The system of claim 11, wherein the at least one processor is further configured to construct the lateral path and the vertical path, by:

defining the circling boundary for visual operation to the optimal runway of the destination airport based on published approach chart data, circling radii guidelines, a circling Minimum Descent Altitude (MDA), aircraft category, timing data, and the temporary circling restrictions; and constructing the lateral path and the vertical path to fly to the optimal runway, based on the circling boundary and the parameters.

13. The system of claim 10, wherein the graphical elements and text associated with the circling approach represent the destination airport, the optimal runway, the lateral path, the vertical path, and the circling boundary associated with the optimal runway.

14. The system of claim 13, wherein the graphical elements and text associated with the circling approach further represent a missed approach point, a non-flyable region of the circling boundary, and a minimum decision altitude.

15. The system of claim 10, wherein the at least one processor is further configured to:

monitor a current trend of the aircraft inside the circling boundary;

wherein the graphical elements and text comprise representations of the current trend.

16. The system of claim 10, wherein the at least one processor is further configured to:

identify a distance to the optimal runway; and present a second visual representation of the distance to the optimal runway, via the display device.

17. The system of claim 10, wherein the at least one processor is further configured to:

predict a potential violation of protected airspace covered by the circling boundary; and provide multi-modal alerts based on the potential violation, onboard the aircraft.

18. The system of claim 10, wherein the at least one processor is further configured to:

determine whether the current approach for the destination airport comprises the circling approach and a circling Minimum Descent Altitude (MDA), based on published approach chart data; and when the current approach comprises the circling approach, construct the lateral path and the vertical path;

identify the circling approach procedure;

determine the circling boundary and the temporary circling restrictions; and present the graphical elements and text.

* * * * *